US010928759B2

(12) United States Patent
Oi et al.

(10) Patent No.: US 10,928,759 B2
(45) Date of Patent: Feb. 23, 2021

(54) HEATING APPARATUS AND IMAGE FORMING APPARATUS FOR CONTROLLING CONDUCTION TO HEAT GENERATION MEMBER

(71) Applicant: CANON KABUSHIKI KAISHA, Tokyo (JP)

(72) Inventors: Ken Oi, Tokyo (JP); Nozomu Nakajima, Kawasaki (JP); Kouji Yasukawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/745,840

(22) Filed: Jan. 17, 2020

(65) Prior Publication Data

US 2020/0233350 A1 Jul. 23, 2020

(30) Foreign Application Priority Data

Jan. 18, 2019 (JP) ..... JP2019-006467

(51) Int. Cl.
*G03G 15/20* (2006.01)
*G03G 15/00* (2006.01)

(52) U.S. Cl.
CPC ..... *G03G 15/2042* (2013.01); *G03G 15/2053* (2013.01); *G03G 15/2064* (2013.01); *G03G 15/80* (2013.01); *G03G 2215/2035* (2013.01)

(58) Field of Classification Search
None
See application file for complete search history.

(56) References Cited

U.S. PATENT DOCUMENTS

| | | | |
|---|---|---|---|
| 8,200,113 | B2 | 6/2012 | Takami |
| 8,600,259 | B2 | 12/2013 | Oi et al. |
| 9,069,301 | B2 | 6/2015 | Oi |
| 10,222,735 | B2 | 3/2019 | Yasukawa et al. |

FOREIGN PATENT DOCUMENTS

| | | | |
|---|---|---|---|
| JP | 2005-77697 | A | 3/2005 |
| JP | 2006-79055 | A | 3/2006 |
| JP | 4979449 | B2 | 7/2012 |
| JP | 2013235181 | A * | 11/2013 |
| JP | 2014-119477 | A | 6/2014 |

OTHER PUBLICATIONS

JP_2013235181_A_T Machine Translation, Japan, Nov. 2013, Mitsuhiro.*
JP_2014119477_A_T Machine Translation, Japan, Jun. 2014, Toshibumi.*

* cited by examiner

*Primary Examiner* — Victor Verbitsky
(74) *Attorney, Agent, or Firm* — Venable LLP

(57) ABSTRACT

In a case where a drive instruction signal in a high level for placing a first triac provided to correspond to a heat generation member in a conduction state is output from a CPU, the first triac is placed in a conduction state after a second triac provided to correspond to a heat generation member is prohibited from being in a conduction state. In a case where a drive instruction signal in a low level for placing the second triac in a non-conduction state is output from the CPU, the state in which the second triac is prohibited from being in the conduction state is released after the first triac is placed in the non-conduction state.

16 Claims, 13 Drawing Sheets

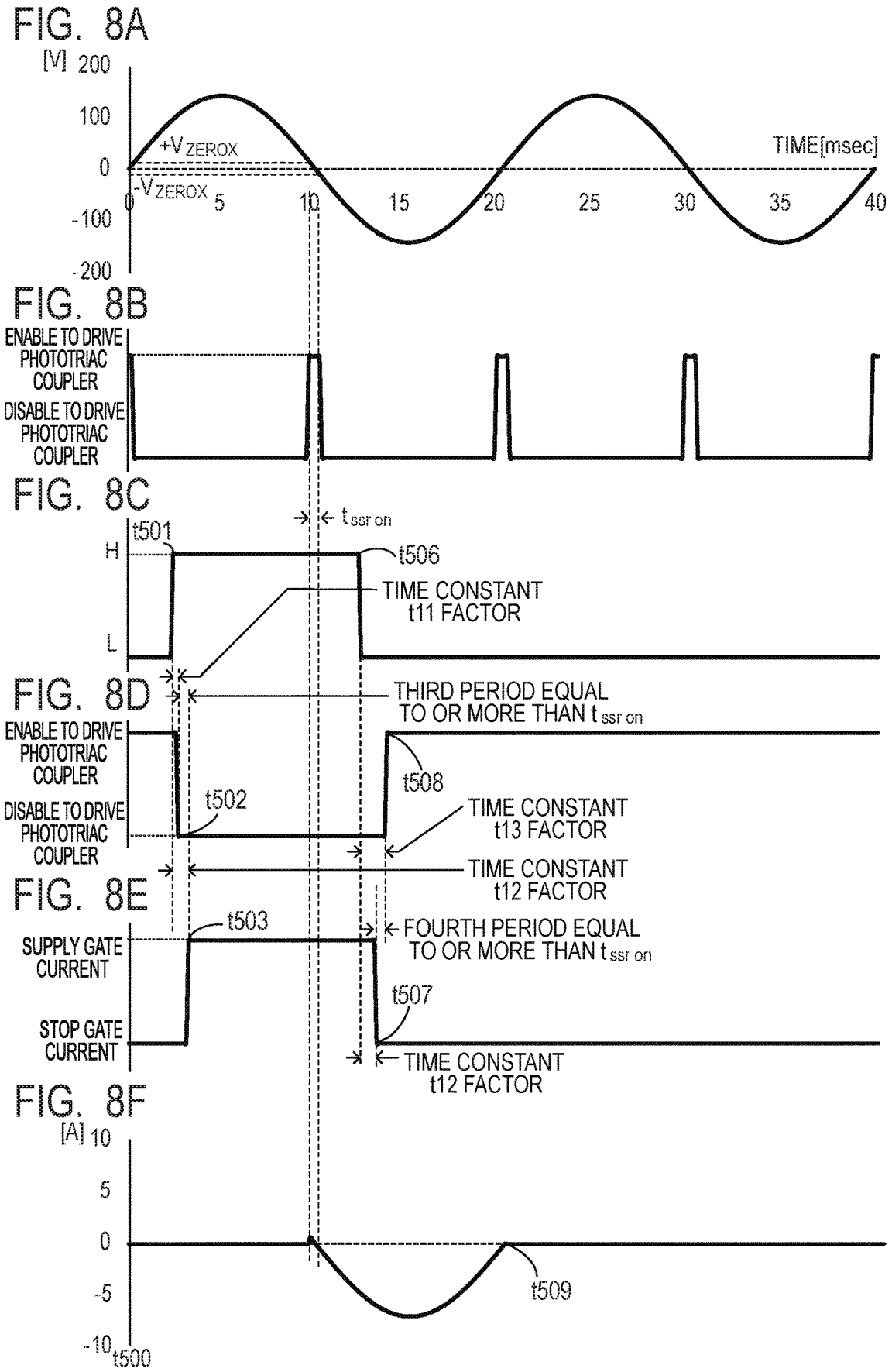
FIG. 8A
[V]
200
100
0
-100
-200
+V ZEROX
-V ZEROX
TIME[msec]
0
5
10
15
20
25
30
35
40
FIG. 8B
ENABLE TO DRIVE PHOTOTRIAC COUPLER
DISABLE TO DRIVE PHOTOTRIAC COUPLER
FIG. 8C
t ssr on
t501
H
L
t506
TIME CONSTANT t11 FACTOR
FIG. 8D
THIRD PERIOD EQUAL TO OR MORE THAN t ssr on
ENABLE TO DRIVE PHOTOTRIAC COUPLER
DISABLE TO DRIVE PHOTOTRIAC COUPLER
t502
t508
TIME CONSTANT t13 FACTOR
TIME CONSTANT t12 FACTOR
FIG. 8E
t503
SUPPLY GATE CURRENT
STOP GATE CURRENT
FOURTH PERIOD EQUAL TO OR MORE THAN t ssr on
t507
TIME CONSTANT t12 FACTOR
FIG. 8F
[A]
10
5
0
-5
-10
t500
t509

HEATING APPARATUS AND IMAGE FORMING APPARATUS FOR CONTROLLING CONDUCTION TO HEAT GENERATION MEMBER

BACKGROUND OF THE INVENTION

Field of the Invention

The present invention relates to a heating apparatus and an image forming apparatus, and particularly to a protection configuration for a control circuit of the heating apparatus used in a fixing apparatus mounted in an image forming apparatus such as a copying machine and a laser printer.

Description of the Related Art

Hitherto, there have been apparatuses that form a toner image on a recording material by an image forming apparatus such as a copying machine and a printer, that is, an electrophotographic-type image forming unit and the like with use of toner formed by a resin and the like having a thermal softening property, and forms a fixed image by performing a heat treatment on the toner image by a fixing apparatus. The fixing apparatus includes a heating member that generates heat when power is supplied to the heating member, a control element that controls the supply of the power, and a temperature detection unit that detects the temperature of the heating member. The fixing apparatus includes a control unit that controls the control element based on the temperature detection result, and a pressurizing member for nipping and conveying the recording material together with the heating member. The control unit controls the heat generation amount of the heating member by driving the control element based on the detection result of the temperature detection unit in many cases. A ceramic heater may be included as a unit that deals with the increase in speed of the image forming apparatus. The ceramic heater is disposed on a ceramic substrate, and includes a heat generation resistive element that generates heat when power is supplied to the heat generation resistive element, a power supplying electrode portion for supplying power to the heat generation resistive element, and an overcoat layer disposed to cover the heat generation resistive element. There is also a configuration that includes a plurality of the heat generation resistive elements and a plurality of the control elements, and provides a high-quality fixity and a high-speed fixing treatment for recording materials with various widths by selecting and adjusting heat generation resistive elements to which power is supplied depending on the width of the recording material.

Now, when the temperature detection unit, the control unit and the like do not function normally, the fixing apparatus stops functioning normally. With regard to such abnormal state, the fixing apparatus is prevented from reaching an overheated state with use of an overheat protection element. Other than the overheat protection element, a configuration in which a safety circuit is provided as illustrated in FIG. 13, for example, is proposed (for example, see Japanese Patent No. 4979449). In this configuration, by limiting the number of the heat generation resistive elements to which the power can be supplied depending on the rotation speed of the pressurizing member, the power that can be supplied to the ceramic heater is changed depending on the rotating state and the non-rotating state of the pressurizing member. Note that details of the configuration in FIG. 13 are described below. When the pressurizing member is in a rotating state, the power amount necessary when the pressurizing member is rotated can be supplied by enabling power to be supplied to all of the heat generation resistive elements. Meanwhile, when the pressurizing member is in a stopped state, by limiting the number of the heat generation resistive elements to which the power can be supplied, damage caused by the overheating of the fixing apparatus in an abnormal state when the pressurizing member is stopped is kept to a minimum.

Due to the increase in the speed of the image forming apparatus in recent years, a high-speed fixing treatment for recording materials with a wider variety of widths is needed. A configuration that includes a plurality of heat generation resistive elements and a plurality of control elements and selects the heat generation resistive elements to which the power is supplied depending on the width of the recording material deals with the increase in speed by using a larger number of heat generation resistive elements to which power can be supplied. Meanwhile, when a situation where power may be simultaneously supplied to a plurality of heat generation resistive elements occurs when the control unit is in an abnormal state due to malfunction and the like, the supplied power amount also increases. As a result, in terms of preventing an excessively overheated state in the abnormal state with use of the overheat protection element and the like, the number of the heat generation resistive elements to which the power is supplied need to be limited so that power is not simultaneously supplied to the plurality of heat generation resistive elements also when the pressurizing member is in a rotating state. However, in the configuration that limits the power depending on the rotation speed of the pressurizing member of the related art, the power supply to the heat generation resistive elements cannot be limited when the pressurizing member is in the rotating state.

SUMMARY OF THE INVENTION

An aspect of the present invention is a heating apparatus including a plurality of heat generation members including a first heat generation member and a second heat generation member, the plurality of heat generation members configured to generate heat by power supplied from an AC power supply, a plurality of connection units each provided to correspond to each of the plurality of heat generation members, the plurality of connection units configured to be placed between in a conduction state in order to supply power to the heat generation members and in a non-conduction state in order to cut off supply of the power, and a control unit configured to control the plurality of connection units, wherein in a case where the control unit outputs a first signal for placing the first connection unit in the conduction state, a first connection unit provided to correspond to the first heat generation member becomes in the conduction state after a second connection unit provided to correspond to the second heat generation member becomes a prohibition state in which the second connection unit is prohibited to be in the conduction state, and wherein in a case where the control unit outputs a second signal for placing the first connection unit in the non-conduction state, the prohibition state of the second connection unit is released after the first connection unit is placed in the non-conduction state.

Another aspect of the present invention is an image forming apparatus including an image forming unit configured to form an unfixed toner image on a recording material, and a heating apparatus having a plurality of heat generation members including a first heat generation member and a second heat generation member, the plurality of heat generation members configured to generate heat by power supplied from an AC power supply, a plurality of connection units each provided to correspond to each of the plurality of heat generation members, the plurality of connection units configured to be placed between in a conduction state in order to supply power to the heat generation members and in a non-conduction state in order to cut off supply of the power, and a control unit configured to control the plurality of connection units, wherein in a case where the control unit outputs a first signal for placing the first connection unit in the conduction state, a first connection unit provided to correspond to the first heat generation member becomes in the conduction state after a second connection unit provided to correspond to the second heat generation member becomes a prohibition state in which the second connection unit is prohibited to be in the conduction state, and wherein in a case where the control unit outputs a second signal for placing the first connection unit in the non-conduction state, the prohibition state of the second connection unit is released after the first connection unit is placed in the non-conduction state, wherein the heating apparatus fixes the unfixed toner image onto the recording material.

Further features of the present invention will become apparent from the following description of exemplary embodiments with reference to the attached drawings.

BRIEF DESCRIPTION OF THE DRAWINGS

FIG. 8A, FIG. 8B, FIG. 8C, FIG. 8D, FIG. 8E and FIG. 8F are timing diagrams illustrating waveforms of the control circuit of Embodiment 2.

DESCRIPTION OF THE EMBODIMENTS

Preferred embodiments of the present invention will now be described in detail in accordance with the accompanying drawings.

Figure 13:
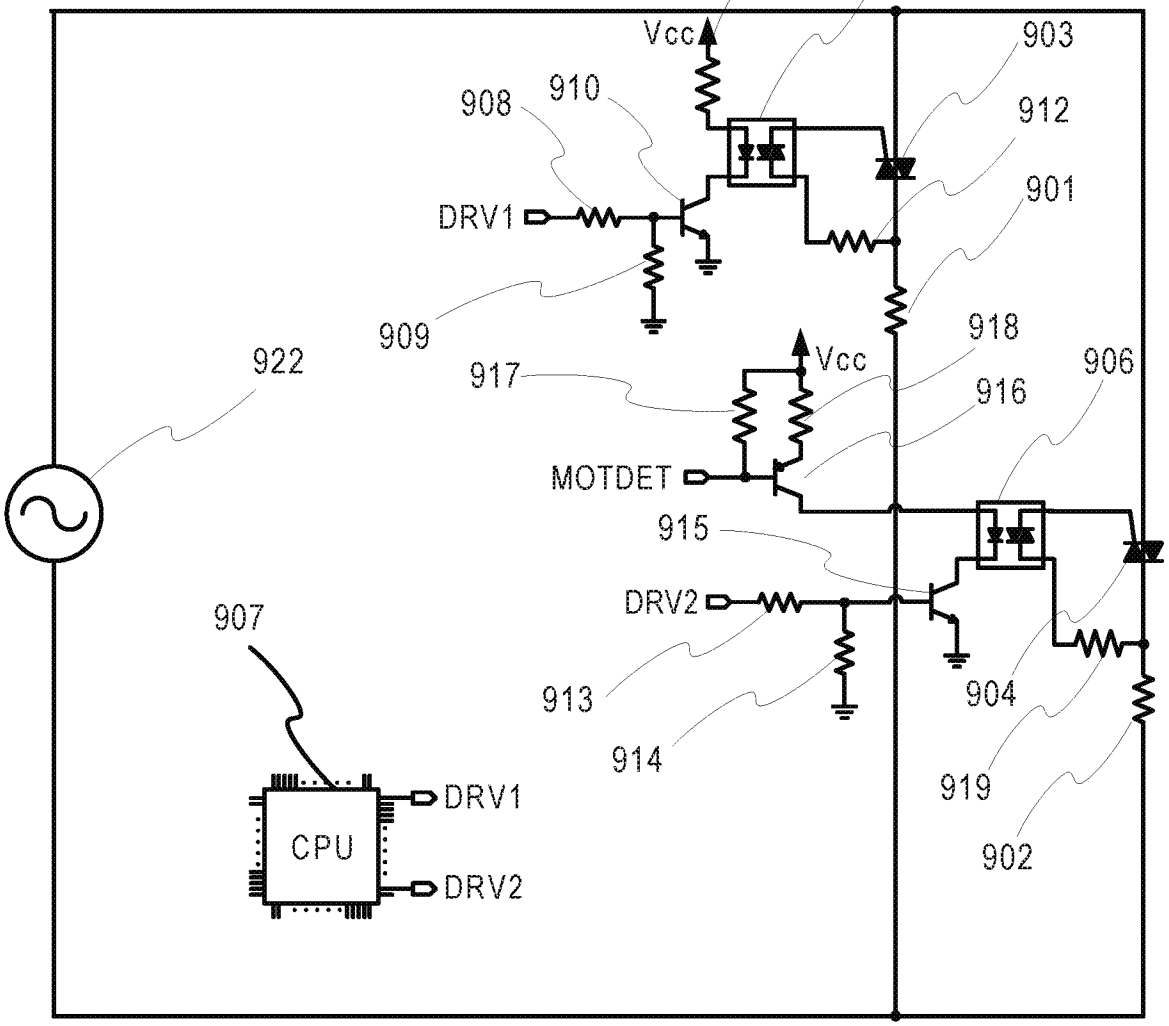
FIG. 13 is an outline view of a protection circuit of a related art example.

[Description of Circuit in FIG. 13]

A circuit in FIG. 13 is described. A bidirectional thyristor for driving (hereinafter referred to as a triac) 903 and a triac 904 are provided for a heat generation member 901 and a heat generation member 902. The gate current of the triacs 903 and 904 is controlled by a phototriac coupler 905 and a phototriac coupler 906. With regard to the triac 903, a drive signal DRV1 is output from a CPU 907. As a result, a base current is supplied to a transistor 910 via a resistor 908, and the transistor 910 is placed in a conduction state. Note that a resistor 909 is a pull-down resistor. When the transistor 910 is placed in the conduction state, current is supplied to a light emitting unit of the phototriac coupler 905 from a power supply voltage Vcc via a resistor 911, and a light receiving unit of the phototriac coupler 905 carries current. As a result, the gate current is supplied to the triac 903 via the resistor 912, and the current supplied from an AC power supply 922 flows to the heat generation member 901. Note that the power supply voltage Vcc is generated by a power supply circuit (not shown) connected to the AC voltage across an AC power supply 55, for example.

Meanwhile, the following is performed for the triac 904. A drive signal DRV2 is output from the CPU 907, and the base current is supplied to a transistor 915 via a resistor 913. Now, a resistor 914 is a pull-down resistor. A MOTDET signal changes depending on the rotating state of the pressurizing member. For example, the MOTDET signal reaches a low level (L) when the pressurizing member is in a rotating state, and reaches a high level (H) when the pressurizing member is in a non-rotating state. When the pressurizing member is in a non-rotating state, a transistor 916 is placed in an OFF state by a pull-up resistor 917, and the gate current is not supplied to the triac 904. Therefore, the phototriac coupler 906 is not placed in the conduction state even when a DRV2 signal is output. On the contrary, when the pressurizing member is in a rotating state, the transistor 916 is placed in the conduction state, and current can be supplied to the light emitting unit of the phototriac coupler 906 from the power supply voltage Vcc via a resistor 918. When the DRV2 signal is output, the gate current is supplied to the triac 904 via the resistor 919, and the triac 904 is placed in the conduction state. When the pressurizing member is in a rotating state, the power amount needed when the pressurizing member is in the rotating state can be supplied by enabling power to be supplied to both of the heat generation members 901 and 902. Meanwhile, when the pressurizing member is in a non-rotating (stopped) state, by limiting the number of the heat generation members to which power can be supplied, damage caused by the overheating of the fixing apparatus in an abnormal state when the rotation of the pressurizing member is in a non-rotating state is kept to a minimum.

Embodiment 1

[Image Forming Apparatus]

Figure 1:
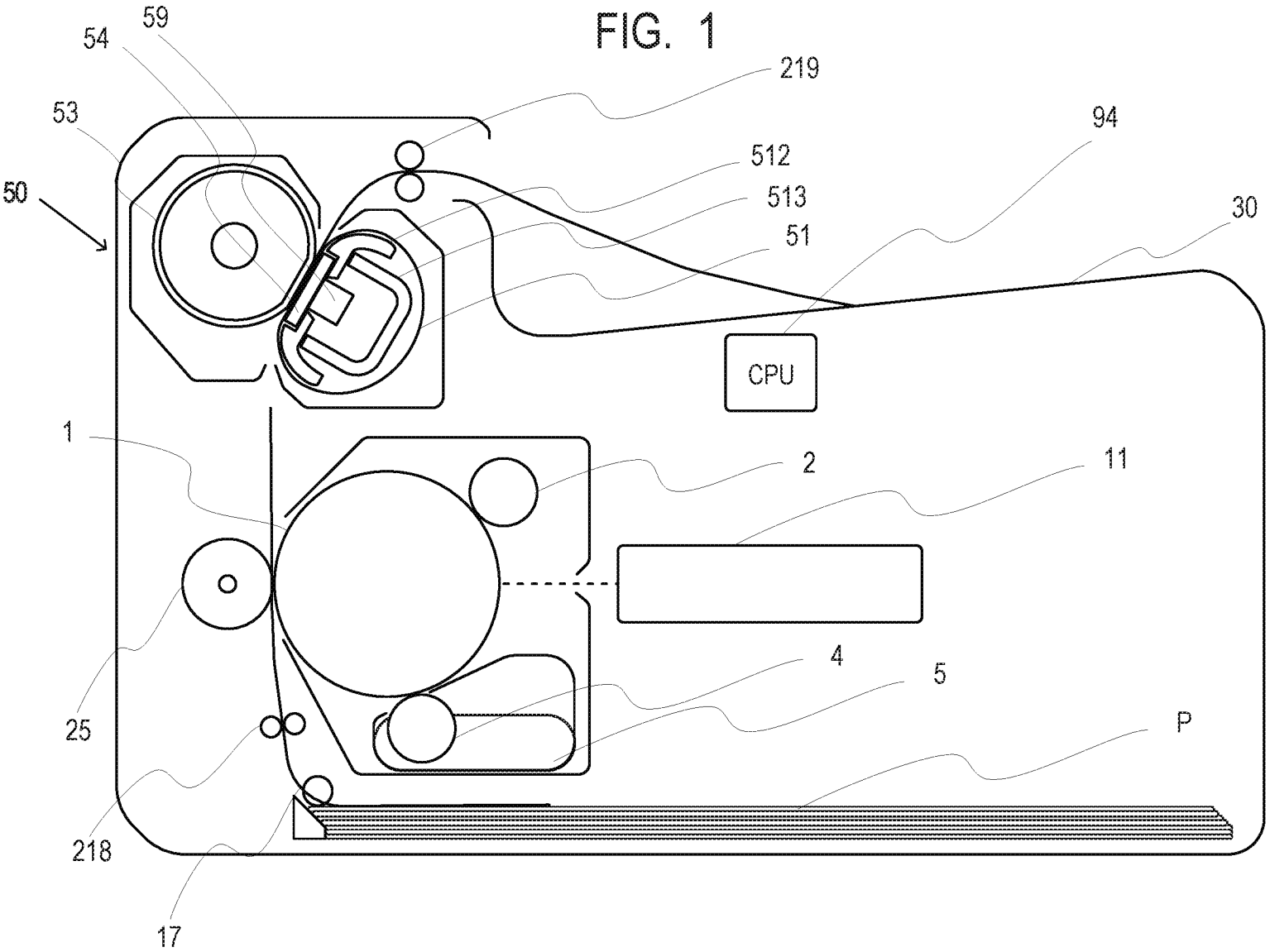
FIG. 1 is an outline view of an image forming apparatus according to Embodiments 1 to 3.

FIG. 1 illustrates one example of an image forming apparatus including a fixing apparatus of Embodiment 1. A photosensitive layer is formed on the front surface of a photosensitive drum 1 serving as an image bearing member. In the photosensitive drum 1, a latent image is formed by irradiation of laser light from an exposure device 11 serving as an exposure unit after a front layer of the photosensitive drum 1 is charged by a charge roller 2 serving as a charge unit. A toner image is formed by applying toner 5 on the latent image on the photosensitive drum 1 by a development roller 4 serving as a developing unit. A transfer roller 25 serving as a transfer unit supplies charge to a sheet P that is a recording material. In a transfer nip portion between the photosensitive drum 1 and the transfer roller 25, an unfixed toner image is transferred onto a conveyed sheet P (onto the recording material), and is conveyed to a fixing apparatus 50 serving as a heating apparatus. A film 51 serving as a first rotary member is a cylindrical fixing film whose longitudinal direction is the depth direction in FIG. 1. A pressure roller 53 serving as a second rotary member is a roller that forms a fixing nip portion N by being pressurized to the film 51 (see FIG. 3A). A heater 54 is a heat generation member including, for example, a substrate made of ceramic, a heat generation member and a protection layer (see FIG. 3B). A stay 512 retains heat generation members 54*b*. A member 513 is a member for reinforcement. A fixing temperature sensor 59 is a temperature detection element such as a thermistor that detects the temperature of the heater 54. By the heating of the heater 54, the unfixed toner image is fixed to the sheet P. Then, the sheet P is output from the fixing nip portion N to an output tray 30 of the image forming apparatus via an output port. Note that a paper feeding roller 17 is a roller for feeding the sheet P, and conveyance rollers 218 and 219 are rollers for conveying the sheet P. A CPU 94 controls power supply from a commercial power supply via a bidirectional thyristor (hereinafter referred to as a triac) described below based on the detection result of the fixing temperature sensor 59.

[Block Diagram of Image Forming Apparatus]

Figure 2:
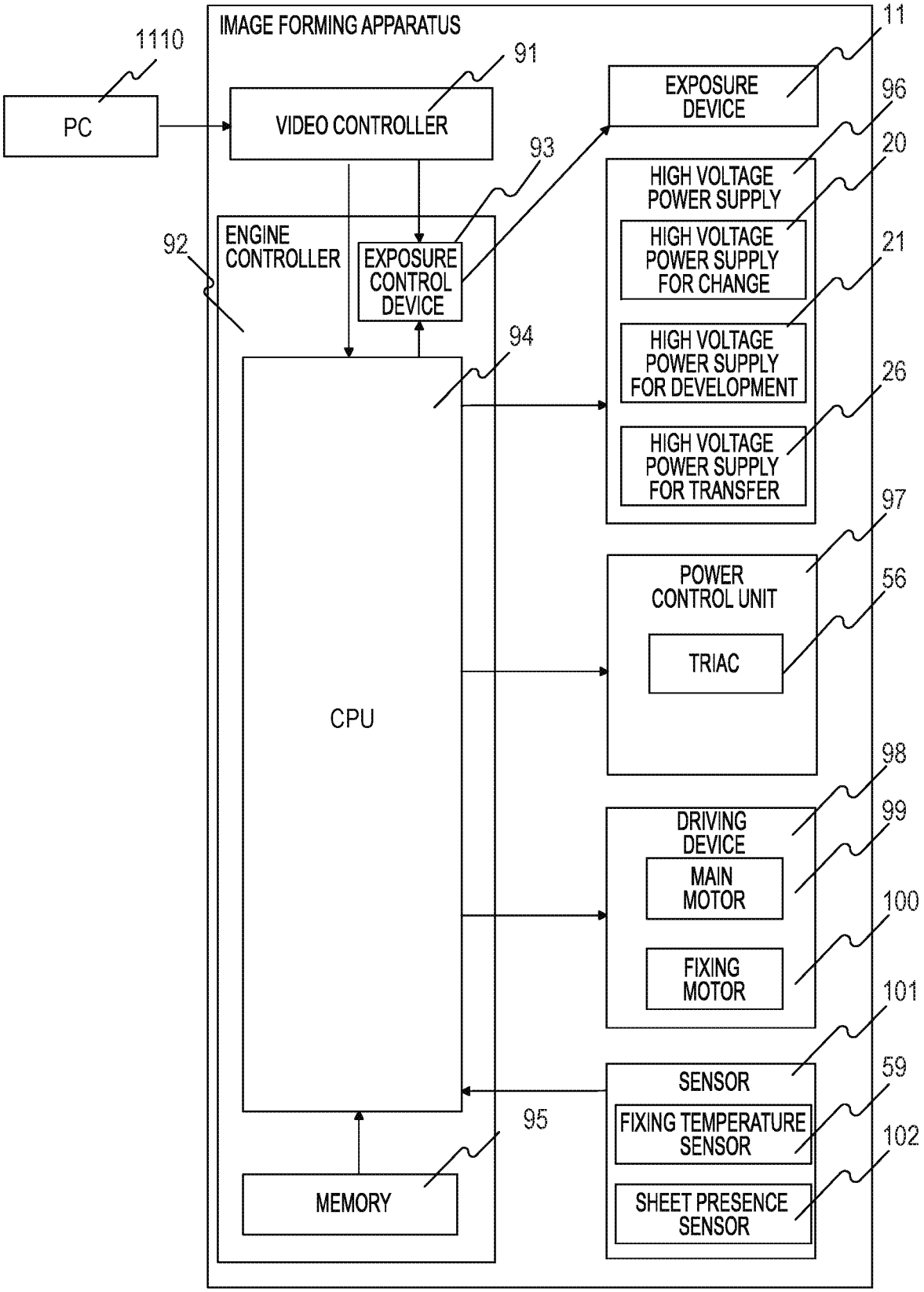
FIG. 2 is a control block diagram of the image forming apparatus according to Embodiments 1 to 3.

FIG. 2 is a block diagram for describing the operation of the image forming apparatus, and the printing operation of the image forming apparatus is described with reference to FIG. 2. A PC 1110 serving as a host computer takes on a role of outputting a printing command to a video controller 91 in the image forming apparatus and transmitting image data of an image to be printed to the video controller 91.

The video controller 91 converts the image data from the PC 1110 to exposure data, and transmits the exposure data to an exposure control device 93 in an engine controller 92. The exposure control device 93 is controlled by the CPU 94, and causes the exposure data to be ON or OFF and controls the exposure device 11. The CPU 94 serving as a control unit starts an image forming sequence when the CPU 94 receives the printing command.

The CPU 94, a memory 95 and the like are mounted on the engine controller 92, and the engine controller 92 performs a preprogrammed operation. A high voltage power supply 96 includes a high voltage power supply 20 for charge, a high voltage power supply 21 for development and a high voltage power supply 26 for transfer. A power control unit 97 includes a bidirectional thyristor (hereinafter referred to as a triac) 56 described below. In the heater 54, power is supplied to either one of a heat generation member 54*b*1 and a heat generation member 54*b*2. The power control unit 97 supplies power to the heat generation members 54*b* that generate heat in the fixing apparatus 50, and determines the power amount to be supplied. A driving device 98 includes a main motor 99, a fixing motor 100 and the like. A sensor 101 includes the fixing temperature sensor 59 that detects the temperature of the fixing apparatus 50, a paper presence sensor 102 that has a flag and detects the presence of the sheet P, and the like, and the detection result of the sensor 101 is transmitted to the CPU 94. The CPU 94 acquires the detection result of the sensor 101 in the image forming apparatus, and controls the exposure device 11, the high voltage power supply 96, the power control unit 97 and the driving device 98. As a result, the CPU 94 performs the formation of an electrostatic latent image, the transfer of the developed toner image, the fixing of the toner image onto the sheet P, and the like, and controls an image formation process in which the exposure data is printed onto the sheet P as a toner image. Note that the image forming apparatus to which the present invention is applied is not limited to the image forming apparatus with the configuration described in FIG. 1, and may be an image forming apparatus capable of printing the sheets P with different widths and including the fixing apparatus 50 including the heater 54 described below.

[Fixing Apparatus]

Figure 3A:
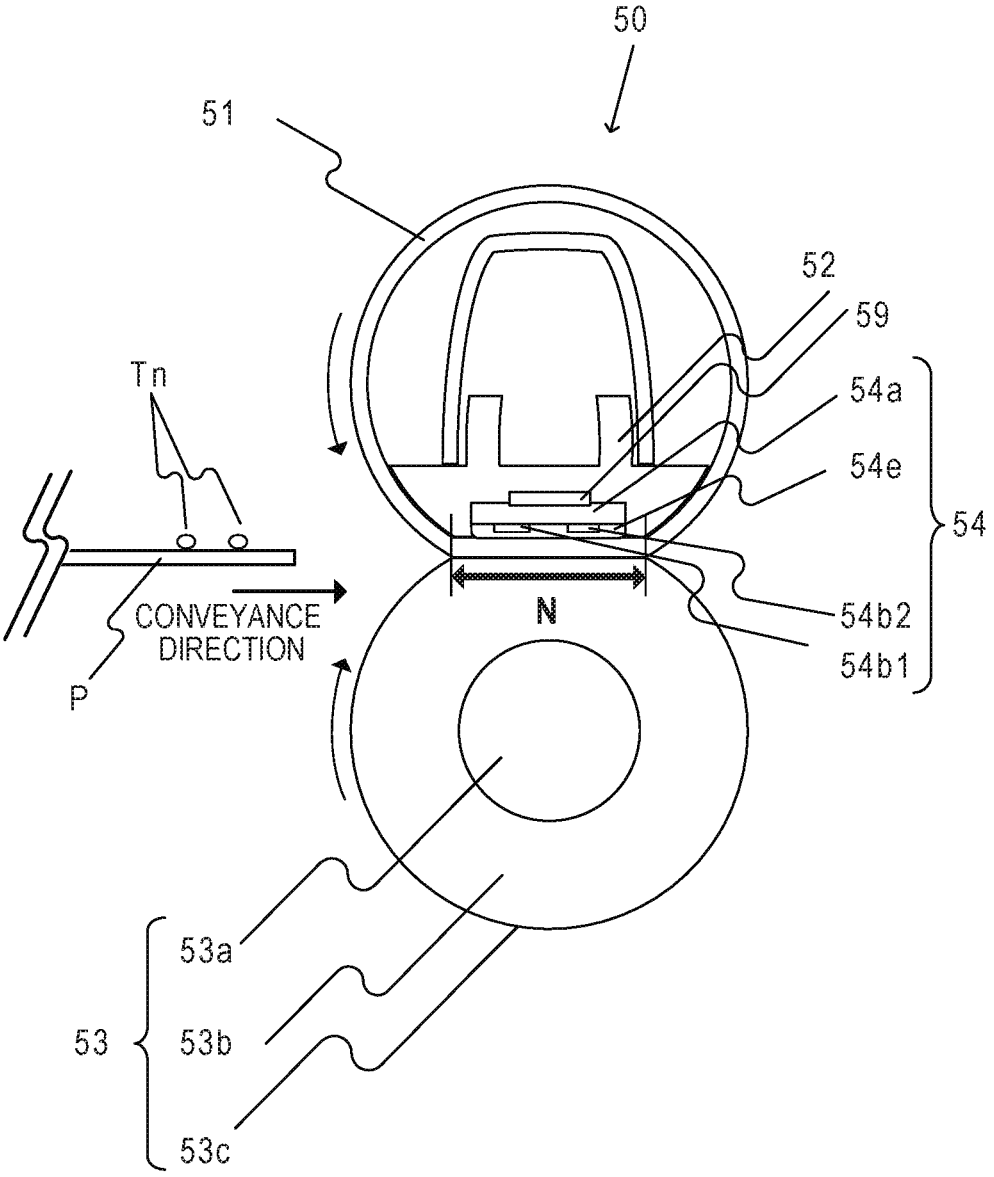
FIG. 3A is a schematic cross-sectional view of a place near a central portion of a fixing apparatus according to Embodiments 1 to 3 in a longitudinal direction.
Figure 3B:
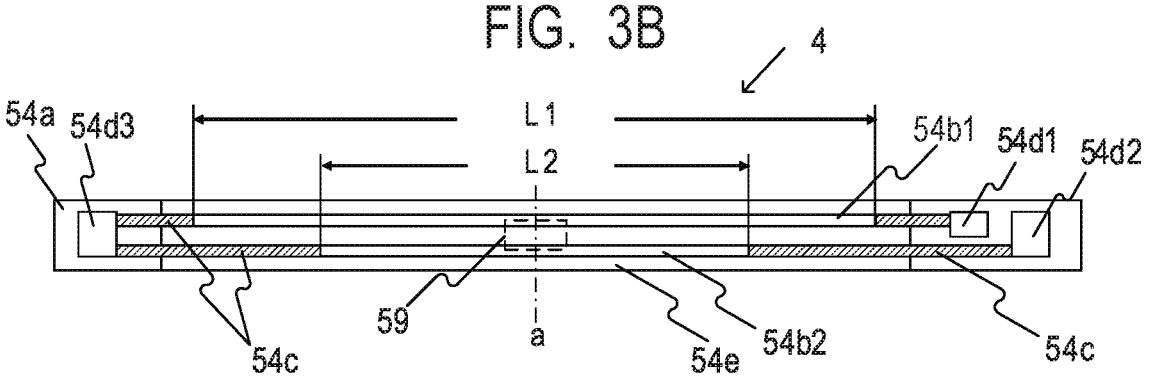
FIG. 3B is a schematic view of a heater of the fixing apparatus according to Embodiments 1 to 3.

Next, the configuration of the fixing apparatus 50 in Embodiment 1 is described with reference to FIG. 3A and FIG. 3B. Here, the longitudinal direction is the rotation axis direction of the pressure roller 53 substantially orthogonal to the conveyance direction of the sheet P described below. The length of the sheet P in a direction (longitudinal direction) substantially orthogonal to the conveyance direction is referred to as the width. FIG. 3A is a schematic cross-sectional view of the fixing apparatus 50, and FIG. 3B is a schematic view of the heater 54.

The sheet P retaining an unfixed toner image Tn is heated at the fixing nip portion N from the left to the right in FIG. 3A while being conveyed from the left side in FIG. 3A. As a result, the toner image Tn is fixed onto the sheet P. The fixing apparatus 50 in Embodiment 1 includes the cylindrical film 51, a nip forming member 52 that retains the film 51, the pressure roller 53 that forms the fixing nip portion N together with the film 51, and the heater 54 for heating the sheet P.

The film 51 is a fixing film serving as a heating rotary member. In Embodiment 1, for example, polyimide is used as a base layer. An elastic layer made of silicone rubber and a release layer made of PFA are used on the base layer. In order to reduce the frictional force generated between the nip forming member 52 and the heater 54 and the film 51 by the rotation of the film 51, grease is applied to the inner surface of the film 51.

The nip forming member 52 serves as a function of guiding the film 51 from the inner side and forming the fixing nip portion N with the pressure roller 53 with the film 51 therebetween. The nip forming member 52 is a member having rigidity, heat resistance and heat insulation property, and is formed by liquid crystal polymer and the like. The film 51 is externally fitted on the nip forming member 52. The pressure roller 53 is a roller serving as a pressurizing rotary member. The pressure roller 53 includes a core 53*a*, an elastic layer 53*b* and a release layer 53*c*. Both ends of the pressure roller 53 are rotatably retained, and the pressure roller 53 is rotatably driven by the fixing motor 100 (see FIG. 2). By the rotation of the pressure roller 53, the film 51 is rotated in a driven manner. The heater 54 serving as a heating member is retained in the nip forming member 52, and is in contact with the inner surface of the film 51. A substrate 54*a*, the heat generation members 54*b*1 and 54*b*2, a protection glass layer 54*e* and the fixing temperature sensor 59 are described below.

(Heater)

The heater 54 is described in detail with reference to FIG. 3B. The heater 54 includes the substrate 54*a*, the heat generation members 54*b*1 and 54*b*2, a conductor 54*c*, contacts 54*d*1 to 54*d*3, and the protection glass layer 54*e*. The heat generation members 54*b*1 and 54*b*2, the conductor 54*c* and the contacts 54*d*1 to 54*d*3 are formed on the substrate 54*a*, and the protection glass layer 54*e* is formed on the above to secure insulation between the heat generation members 54*b*1 and 54*b*2 and the film 51. The heat generation member 54*b*1 and the heat generation member 54*b*2 have different lengths (hereinafter also referred to as sizes) in the longitudinal direction. Specifically, the length of the heat generation member 54*b*1 in the longitudinal direction is L1 that is a first length, the length of the heat generation member 54*b*2 in the longitudinal direction is L2 that is a second length, and the relationship between the length L1 and the length L2 is L1>L2. The length L1 of the heat generation member 54*b*1 is a length capable of fixing a sheet P with the maximum width (hereinafter referred to as a maximum paper feeding width) out of the sheets P that can be printed (or conveyed) by the image forming apparatus. The sheet P with the length L1 that is a recording material with the first width is hereinafter also referred to as the sheet P with the width L1, and the sheet P with the length L2 that is a recording material with the second width is hereinafter also referred to as the sheet P with the width L2. The heat generation member 54*b*1 is electrically connected to the contacts 54*d*1 and 54*d*3 via the conductor 54*c*, and the heat generation member 54*b*2 is electrically connected to the contacts 54*d*2 and 54*d*3 via the conductor 54*c*. In other words, the contact 54*d*3 is a contact commonly connected to the heat generation members 54*b*1 and 54*b*2.

The fixing temperature sensor 59 is located on a surface opposite to the protection glass layer 54*e* with respect to the substrate 54*a*, and is placed in a center position a in the longitudinal direction of the heat generation members 54*b*1 and 54*b*2 to be in contact with the substrate 54*a*. The fixing temperature sensor 59 is a thermistor, for example, and detects the temperature of the heater 54 and outputs the detection result to the CPU 94. The CPU 94 controls the temperature at the time of the fixing treatment based on the detection result of the fixing temperature sensor 59.

[Control Circuit]

Figure 4:
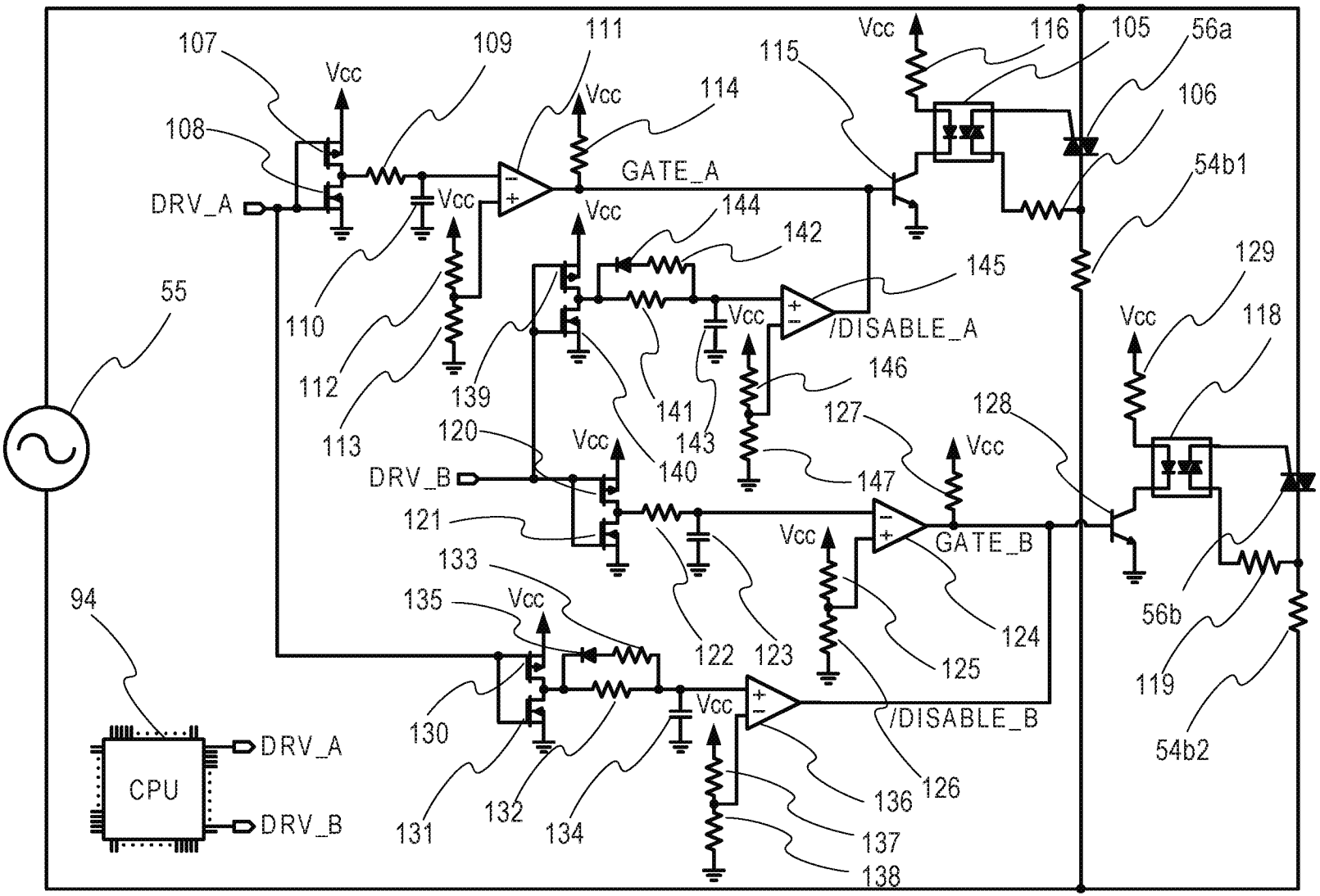
FIG. 4 is an outline view of a control circuit of Embodiment 1.

FIG. 4 is an outline view of a control circuit of Embodiment 1. A control circuit unit to the heater 54 is as follows. The heater 54 generates heat when power is supplied to one of the heat generation member 54*b*1 and the heat generation member 54*b*2 from the AC power supply 55. The CPU 94 determines the heat generation member to which power is supplied out of the heat generation member 54*b*1 and the heat generation member 54*b*2 depending on the length of the sheet P with respect to the longitudinal direction of the heater 54, for example. The CPU 94 performs control so that power is supplied to only one of the heat generation member 54*b*1 and the heat generation member 54*b*2.

(GATE_A Signal)

A triac 56*a* is a triac that supplies power to the heat generation member 54*b*1 or cuts off the supply of the power. When a light receiving unit of a phototriac coupler 105 serving as a first driving unit carries current, the gate current limited by a gate resistor 106 is supplied to the triac 56*a*, and the triac 56*a* is placed in the conduction state. The phototriac coupler 105 can carry current only when the voltage across both ends of the light receiving unit is equal to or less than the predetermined voltage. When the current flowing to the triac 56*a* reaches a zero crossing point in a state in which the gate current is not supplied, the triac 56*a* changes from the conduction state to a non-conduction state.

The phototriac coupler 105 is controlled as follows. The CPU 94 is driven by the power supply voltage Vcc generated by a power supply (not shown). The CPU 94 sets a drive instruction signal DRV_A for driving (causing current to flow through) the triac 56*a* to the high level. As a result, the voltage output from a first CMOS output unit formed by a field effect transistor (hereinafter referred to as a FET) 107 and a FET 108 reaches the low level. The drive instruction signal DRV_A is input to the gate terminals of the FET 107 and the FET 108. The FET 107 has a source terminal connected to the power supply voltage Vcc, and a drain terminal connected to a drain terminal of the FET 108 and an inverting input terminal of a comparator 111. The FET 108 has a source terminal that is grounded, and a drain terminal connected to the drain terminal of the FET 107 and the inverting input terminal of the comparator 111.

From the above, when the drive instruction signal DRV_A in the high level serving as a first signal is input, the FET 107 becomes OFF, the FET 108 becomes ON, and the voltage output from the first CMOS output unit reaches the low level. When the drive instruction signal DRV_A in the low level serving as a second signal is input, the FET 107 becomes ON, the FET 108 becomes OFF, and the voltage output from the first CMOS output unit reaches the high level.

The first CMOS output unit is connected to the inverting input terminal of the comparator 111 via a resistor 109. The comparator 111 compares the voltage output from the first CMOS output unit and a first reference voltage obtained by a resistor 112 and a resistor 113 connected to a non-inverting input terminal. The voltage applied to the inverting input terminal of the comparator 111 changes by the time constant of the resistor 109 and a capacitor 110. In other words, the voltage of the inverting input terminal of the comparator 111 changes with a delay of the time specified by the time constant of the resistor 109 and the capacitor 110 after the output of the drive instruction signal DRV_A changes. The first CMOS output unit, the resistor 109 and the capacitor 110 function as a first drive signal unit.

When the voltage to the inverting input terminal of the comparator 111 is equal to or less than the first reference voltage, the output terminal of the comparator 111 is placed in a high-impedance state. As a result, the base current flows from the power supply voltage Vcc via a resistor 114, and hence a signal GATE_A in the high level serving as a first drive signal is supplied to a base terminal of a transistor 115. As a result, the transistor 115 becomes ON. By causing the transistor 115 to be ON, current flows to a light emitting unit of the phototriac coupler 105 from the power supply voltage Vcc via a resistor 116, and the light receiving unit of the phototriac coupler 105 is placed in the conduction state. As a result, the triac 56*a* carries current (becomes ON).

(Signal GATE_B)

The supply of power to the heat generation member 54*b*2 and the cut off of the supply of power are performed by a triac 56*b*. When a light receiving unit of a phototriac coupler 118 serving as a second driving unit is placed in the conduction state, the gate current limited by the gate resistor 119 is supplied to the triac 56*b*, and the triac 56*b* is placed in the conduction state. The phototriac coupler 118 can carry current only when the voltage across both ends of the light receiving unit is equal to or less than a predetermined voltage. As with the triac 56*a*, when the current supplied to the triac 56*b* reaches a zero crossing point in a state in which the gate current is not supplied, the triac 56*b* changes from the conduction state to the non-conduction state.

The CPU 94 outputs a drive instruction signal DRV_B to the phototriac coupler 118 as a drive instruction signal. When the CPU 94 sets the drive instruction signal DRV_B to the high level, a second CMOS output unit formed by a FET 120 and a FET 121 reaches the low level. The drive instruction signal DRV_B is input to gate terminals of the FET 120 and the FET 121. The FET 120 has a source terminal connected to the power supply voltage Vcc, and a drain terminal connected to a drain terminal of the FET 121 and an inverting input terminal of a comparator 124. The FET 121 has a source terminal that is grounded, and a drain terminal connected to the drain terminal of the FET 120 and the inverting input terminal of the comparator 124.

From the above, when the drive instruction signal DRV_B in the high level serving as a first signal is input, the FET 120 becomes OFF, the FET 121 becomes ON, and the voltage output from the second CMOS output unit reaches the low level. When the drive instruction signal DRV_B in the low level serving as a second signal is input, the FET 120 becomes ON, the FET 121 becomes OFF, and the voltage output from the second CMOS output unit reaches the high level.

The second CMOS output unit is connected to the inverting input terminal of the comparator 124 via a resistor 122. The comparator 124 compares the voltage output from the second CMOS output unit and a second reference voltage obtained by a resistor 125 and a resistor 126 connected to the non-inverting input terminal. The voltage applied to the inverting input terminal of the comparator 124 changes by the time constant of the resistor 122 and a capacitor 123. In other words, the voltage of the inverting input terminal of the comparator 124 changes with a delay of the time specified by the time constant of the resistor 122 and the capacitor 123 after the output of the drive instruction signal DRV_B changes. The second CMOS output unit, the resistor 122 and the capacitor 123 function as a first drive signal unit.

When the voltage to the inverting input terminal of the comparator 124 is equal to or less than the second reference voltage, an output terminal of the comparator 124 is placed in a high-impedance state. As a result, when the base current flows from the power supply voltage Vcc via a resistor 127, a signal GATE_B in the high level serving as a first drive signal is supplied to a base terminal of a transistor 128. As a result, the transistor 128 becomes ON. When the transistor 128 becomes ON, current flows to the light emitting unit of the phototriac coupler 118 from the power supply voltage Vcc via the resistor 129, and the light receiving unit of the phototriac coupler 118 is placed in the conduction state. As a result, the triac **56*b* carries current (becomes ON). The triacs 56*a* and 56*b* are hereinafter collectively referred to as triacs 56**, and the drive instruction signals DRV_A and DRV_B are hereinafter collectively referred to as drive instruction signals DRV.

(Signal/DISABLE_B)

When the drive instruction signal DRV is output for one of the triacs 56, the drive signal (one of the signal GATE_A and the signal GATE_B) for the other of the triacs 56 is as follows. When the drive instruction signal DRV_A in the high level is output from the CPU 94, a third CMOS output unit formed by a FET 130 and a FET 131 reaches the low level. The drive instruction signal DRV_A is input to the gate terminals of the FET 130 and the FET 131. The FET 130 has a source terminal connected to the power supply voltage Vcc, and a drain terminal connected to a drain terminal of the FET 131 and a non-inverting input terminal of a comparator 136. The FET 131 has a source terminal that is grounded, and a drain terminal connected to the drain terminal of the FET 130 and the non-inverting input terminal of the comparator 136. When the drive instruction signal DRV_A in the high level is input, the FET 130 becomes OFF, the FET 131 becomes ON, and the voltage output from the third CMOS output unit reaches the low level. When the drive instruction signal DRV_A in the low level is input, the FET 130 becomes ON, the FET 131 becomes OFF, and the voltage output from the third CMOS output unit reaches the high level.

The third CMOS output unit has an output terminal connected to the non-inverting input terminal of the comparator 136 via a resistor 132. The resistor 132 is parallelly connected to a circuit in which a diode 135 and a resistor 133 are connected in series with each other. The diode 135 has a cathode terminal connected to the output terminal of the third CMOS output unit, and an anode terminal connected to one end of the resistor 133. The other end of the resistor 133 is connected to the non-inverting input terminal of the comparator 136. As a result, the time (the time constant of the circuit) by which the voltage to be input to the non-inverting input terminal of the comparator 136 is delayed changes depending on the state of the output terminal of the third CMOS output unit. Details are described below.

(When Transition of Third CMOS Output Unit is from H to L)

When the voltage output from the third CMOS output unit transitions from the high level to the low level, the voltage of the non-inverting input terminal of the comparator 136 changes by the time constant of a circuit including the resistor 132, the resistor 133 and a capacitor 134. In other words, the output of the drive instruction signal DRV_A changes and the voltage of the non-inverting input terminal of the comparator 136 changes with a delay of the time specified by the time constant of the resistors 132 and 133 and the capacitor 134. The third CMOS output unit, the resistor 132, the resistor 133 and the capacitor 134 function as a second drive signal unit.

The comparator 136 compares the voltage of the non-inverting input terminal and a third reference voltage obtained by a resistor 137 and a resistor 138 connected to the inverting input terminal. The comparator 136 outputs a signal /DISABLE_B in the low level serving as a prohibiting signal from an output terminal when the voltage of the non-inverting input terminal is less than the third reference voltage as a result of the comparison. When the signal /DISABLE_B is in the low level state, the signal GATE_B is fixed to the low level and is placed in an invalid state. In other words, the triac **56*b*** is placed in a state of being prohibited from being in the conduction state. For example, the first reference voltage and the third reference voltage are set as 1/2×Vcc. The relationship of the time constant between the signal /DISABLE_B and the signal GATE_A when the output of the third CMOS output unit transitions from the high level to the low level is expressed as follows:

$$\{(R132\times R133)/(R132+R133)\}\times C134<R109\times C110$$

where a time constant {(R132×R133)/(R132+R133)}×C134 is represented by τ1 and a time constant R109×C110 is represented by τ2. As a result, when the drive instruction signal DRV_A in the high level is output from the CPU 94, the signal /DISABLE_B is placed in the low level state first and then the signal GATE_A is placed in the high level state. In other words, the triac **56*a* is placed in the conduction state after the control of the triac 56*b* becomes invalid first. Now, R109, R132 and R133 represent resistance values of the resistor 109, the resistor 132 and the resistor 133. Further, C110 and C134 represent capacity values of the capacitor 110 and the capacitor 134**.

(When Transition of Third CMOS Output Unit is from L to H)

When the voltage output from the third CMOS output unit transitions from the low level to the high level, the voltage of the non-inverting input terminal of the comparator 136 rises by a time constant R132×C134 obtained by the resistor 132 and the capacitor 134. In other words, the voltage of the non-inverting input terminal of the comparator 136 rises with a delay of the time specified by the time constant of the resistor 132 and the capacitor 134 after the output of the drive instruction signal DRV_A changes. When the voltage of the non-inverting input terminal is equal to or more than the third reference voltage as a result of the comparison by the comparator 136, the signal /DISABLE_B is placed in a high-impedance state (corresponding to a release signal). The relationship of the time constant between the signal /DISABLE_B and the signal GATE_A when the output of the third CMOS output unit transitions from the low level to the high level is expressed as follows:

$$R132 \times C134 > R109C110$$

where a time constant R132×C134 is represented by τ3. As a result, when the drive instruction signal DRV_A in the low level is output from the CPU 94, the signal GATE_A reaches the low level first. Then, after the triac 56*a* stops, the signal /DISABLE_B is placed in a high-impedance state. In other words, the invalid state of the control of the triac 56*b* is released after the triac 56*a* is placed in the non-conduction state first.

(Signal /DISABLE_A)

When the drive instruction signal DRV_B in the high level is output from the CPU 94, the output from a fourth CMOS output unit formed by a FET 139 and a FET 140 reaches the low level. The drive instruction signal DRV_B is input to gate terminals of the FET 139 and the FET 140. The FET 139 has a source terminal connected to the voltage Vcc, and a drain terminal connected to a drain terminal of the FET 140 and a non-inverting input terminal of a comparator 145. The FET 140 has a source terminal that is grounded, and a drain terminal connected to the drain terminal of the FET 139 and the non-inverting input terminal of the comparator 145. When the drive instruction signal DRV_B in the high level is input, the FET 139 becomes OFF, the FET 140 becomes ON, and the voltage output from the fourth CMOS output unit reaches the low level. When the drive instruction signal DRV_B in the low level is input, the FET 139 becomes ON, the FET 140 becomes OFF, and the voltage output from the fourth CMOS output unit reaches the high level.

The fourth CMOS output unit has an output terminal connected to the non-inverting input terminal of the comparator 145 via a resistor 141. The resistor 141 is parallelly connected to a circuit in which a diode 144 and a resistor 142 are connected in series with each other. The diode 144 has a cathode terminal connected to the output terminal of the fourth CMOS output unit, and an anode terminal connected to one end of the resistor 142. The other end of the resistor 142 is connected to the non-inverting input terminal of the comparator 145. As a result, the time (the time constant of the circuit) by which the voltage input to the non-inverting input terminal of the comparator 145 is delayed changes depending on the state of the output terminal of the fourth CMOS output unit. Details are described below.

(When Transition of Fourth CMOS Output Unit is from H to L)

When the voltage output from the fourth CMOS output unit transitions from the high level to the low level, the voltage of the non-inverting input terminal of the comparator 145 decreases by the time constant of the resistor 141, the resistor 142 and a capacitor 143. In other words, the voltage of the non-inverting input terminal of the comparator 145 decreases with a delay of the time specified by the time constant of the resistors 141 and 142 and the capacitor 143 after the output of the drive instruction signal DRV_B changes. The fourth CMOS output unit, the resistor 141, the resistor 142 and the capacitor 143 function as a second drive signal unit.

The comparator 145 compares the voltage of the non-inverting input terminal and a fourth reference voltage obtained by a resistor 146 and a resistor 147 connected to the inverting input terminal. When the voltage of the non-inverting input terminal is less than the fourth reference voltage as a result of the comparison, the comparator 145 outputs a signal /DISABLE_A in the low level serving as a prohibiting signal from the output terminal. When the signal /DISABLE_A is in the low level state, the signal GATE_A is fixed to the low level and is placed in an invalid state. For example, the second reference voltage and the fourth reference voltage are set as 1/2×Vcc. The relationship of the time constant between the signal /DISABLE_A and the signal GATE_B when the output of the fourth CMOS output unit transitions from the high level to the low level is expressed as follows:

$$\{(R141 \times R142)/(R141+R142)\} \times C143 < R122 \times C123$$

where a time constant {(R141×R142)/(R141+R142)}×C143 is represented by τ4 and a time constant R122×C123 is represented by τ5. As a result, when the drive instruction signal DRV_B in the high level is output from the CPU 94, the signal GATE_B is placed in the high level state after the signal /DISABLE_A reaches the low level state first. In other words, the triac 56*b* is placed in the conduction state after the control of the triac 56*a* is placed in an invalid state first. Here, R122, R141 and R142 represent resistance values of the resistor 122, the resistor 141 and the resistor 142. Further, C123 and C143 represent capacity values of the capacitor 123 and the capacitor 143.

(When Transition of Fourth CMOS Output Unit is from L to H)

When the voltage output from the fourth CMOS output unit transitions from the low level to the high level, the voltage of the non-inverting input terminal of the comparator 145 rises by a time constant R141×C143 obtained by the resistor 141 and the capacitor 143. In other words, the voltage of the non-inverting input terminal of the comparator 145 rises with a delay of the time specified by the time constant of the resistor 141 and the capacitor 143 after the output of the drive instruction signal DRV_B changes. When the voltage of the non-inverting input terminal is equal to or more than the fourth reference voltage as a result of the comparison by the comparator 145, the signal /DISABLE_A is placed in a high-impedance state (corresponds to a release signal). The relationship of the time constant between the signal /DISABLE_A and the signal GATE_B when the output of the fourth CMOS output unit transitions from the low level to the high level is expressed as follows:

$$R141 \times C143 > R122 \times C123$$

where a time constant R141×C143 is represented by τ6. As a result, when the drive instruction signal DRV_B in the low level is output from the CPU 94, the signal /DISABLE_A is placed in a high-impedance state after the signal GATE_B reaches the low level first and the triac 56*b* is stopped. In other words, the invalid state of the control of the triac 56*a* is released after the triac 56*b* is placed in the non-conduction state first.

As described above, when the drive instruction signal DRV_A reaches the high level, the time constant τ2 is set to be longer than the time constant τ1 (τ1<τ2). Meanwhile, when the drive instruction signal DRV_A reaches the low level, the time constant τ3 is set to be longer than the time constant τ2 (τ2<τ3). The time constant τ5 is set to be longer than the time constant τ4 (τ4<τ5) when the drive instruction signal DRV_B reaches the high level, and the time constant τ6 is set to be longer than the time constant τ5 (τ5<τ6) when the drive instruction signal DRV_B reaches the low level.

[Operation of Control Circuit]

Figure 5A:
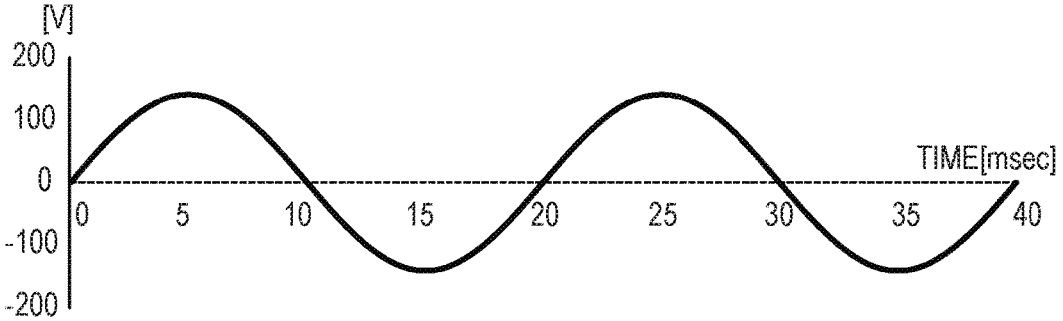
FIG. 5A, FIG. 5B, FIG. 5C, FIG. 5D and FIG. 5E are timing diagrams illustrating waveforms of the control circuit of Embodiment 1.
Figure 5B:
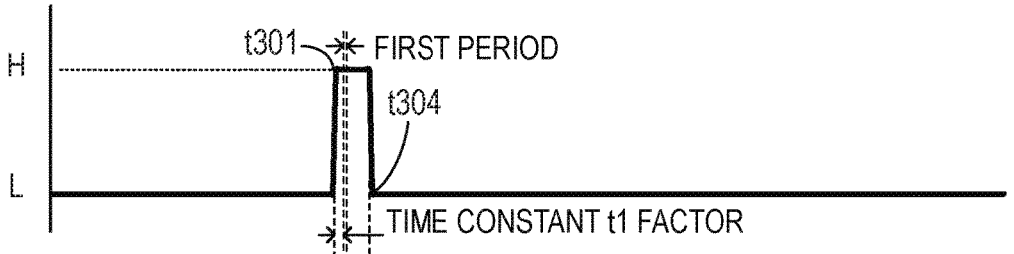
Figure 5C:
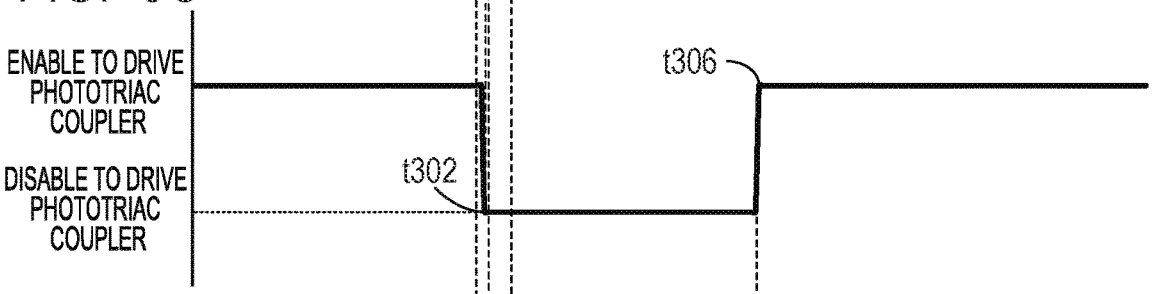
Figure 5D:
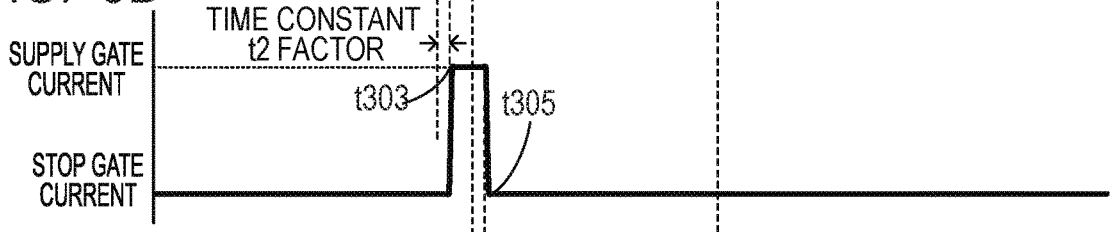
Figure 5E:
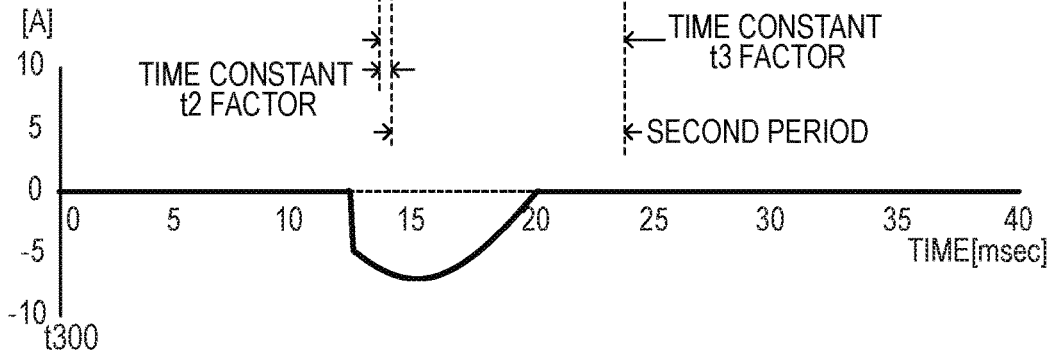

FIG. 5A to FIG. 5E illustrate the relationship between the AC power supply 55, the drive instruction signal DRV_A, the signal /DISABLE_B, the signal GATE_A, the current supplied to the triac 56*a* and elapsed time. FIG. 5A illustrates the waveform of the AC power supply 55 [V], and FIG. 5B illustrates the waveform (the high level (H) and the low level (L)) of the drive instruction signal DRV_A. FIG. 5C illustrates the waveform of the signal /DISABLE_B, and sets the high level as an "enabling state for driving" and the low level as a "disabling state for driving". FIG. 5D illustrates the waveform of the signal GATE_A, and sets the high level as a "state in which gate current is supplied" and the low level as a "state in which gate current is stopped". FIG. 5E illustrates the waveform of the current [A] supplied to the triac 56*a*. In all cases, the horizontal axis indicates time [milliseconds (msec)].

Note that constants of the resistors and the like relating to the waveforms of FIG. 5A to FIG. 5E are as follows, for example. The AC power supply 55 is an AC voltage with a voltage of 100 Vac and a frequency of 50 Hz (cycle of 20 msec), and each of the heat generation members 54*b*1 and 54*b*2 is about 20Ω. The power supply voltage Vcc is 3.3 V, and the resistor 112, the resistor 113, the resistor 125, the resistor 126, the resistor 137, the resistor 138, the resistor 146 and the resistor 147 that determine the first reference voltage to the fourth reference voltage are all 10 kΩ. By setting resistor constants as above, the first reference voltage and the third reference voltage are set as 1/2×Vcc. The resistor 109, the capacitor 110, the resistor 122 and the capacitor 123 that determine the time constants of the signal GATE_A with respect to the drive instruction signal DRV_A and the signal GATE_B with respect to the drive instruction signal DRV_B are about 10 kΩ and about 4700 pF. The resistor 132 and the resistor 141 that determine the time constants of the signal /DISABLE_B with respect to the drive instruction signal DRV_A and the signal /DISABLE_A with respect to the drive instruction signal DRV_B is about 420 kΩ. The resistor 133 and the resistor 142 are about 100Ω, and the capacitor 134 and the capacitor 143 are about 0.047 μF.

(Conduction (ON) of Triac 56*a*)

The drive instruction signal DRV_A reaches the high level at a timing t301 at which about 12 msec has elapsed from a timing t300 (0 msec) serving as a reference (FIG. 5B). The signal /DISABLE_B changes to the low level at a timing t302 at which about 5 μsec has elapsed from the change of the drive instruction signal DRV_A to the high level at the timing t301 (FIG. 5C). The time from the timing t301 to the timing t302 corresponds to the time constant τ1. The signal GATE_A changes to the high level at a timing t303 at which about 35 μsec has elapsed from the change of the drive instruction signal DRV_A to the high level at the timing t301 (FIG. 5D). The time from the timing t301 to the timing t303 corresponds to the time constant τ2. As described above, the time constant τ2 is set to be longer than the time constant τ1 (τ2>τ1). When the period from when the signal /DISABLE_B is output to when the signal GATE_A is output is set to be a first period (τ2−τ1), the first period in Embodiment 1 is about 30 (35−5) μsec. In other words, the gate current is supplied to the triac 56*a* after about 30 μsec has elapsed from when the signal GATE_B is placed in an invalid state by the signal /DISABLE_B (FIG. 5E).

(Non-Conduction (OFF) of Triac 56*a*)

The drive instruction signal DRV_A reaches the low level at a timing t304 at which about 14 msec has elapsed from the timing t300 (FIG. 5B). At the timing t304, the zero crossing point is not reached (FIG. 5A), and hence power is continued to be supplied to the heat generation member 54*b*1 by the triac 56*a* (FIG. 5E).

The signal GATE_A belatedly changes to the low level at a timing t305 at which about 35 μsec has elapsed from the change of the drive instruction signal DRV_A from the high level to the low level at the timing t304 (FIG. 5D). The time from the timing t304 to the timing t305 corresponds to the time constant τ2. The signal /DISABLE_B is placed in a high-impedance state at a timing t306 at which about 13.6 msec has elapsed from the timing t304 (FIG. 5C). The time from the timing t304 to the timing t306 corresponds to the time constant τ3. As described above, the time constant τ3 is set to be longer than the time constant τ2. When the period (τ2−τ3) from the timing t305 at which the signal GATE_A is placed in the low level state to the timing t306 at which the signal /DISABLE_B is placed in a high-impedance state is set as a second period, the second period is a time as follows. In other words, the second period in Embodiment 1 is about 13.5 (13.6−0.035) msec. Note that the second period can be said to be a period from when the triac 56*a* is placed in the non-conduction state to when the state in which the conduction state of the triac 56*b* is prohibited is released. Now, the second period is set to be longer than a half-wave cycle (a half of one cycle; half cycle) (13.5 msec>10 msec) of the AC voltage across the AC power supply 55. As a result, the current supplied by the triac 56*a* reliably reaches the zero crossing point (FIG. 5E), and the driving of the triac 56*b* is enabled after the triac 56*a* is reliably placed in the non-conduction state.

As described above, the control circuit of Embodiment 1 operates as follows when one of the triacs 56 serving as a first connection unit for supplying power to one of the heat generation members 54*b* serving as a first heat generation member is placed in the conduction state. In other words, first, the other of the triacs 56 serving as a second connection unit for supplying power to the other of the heat generation members 54*b* serving as a second heat generation member is prohibited from being placed in the conduction state. Then, one of the triacs 56 is placed in the conduction state. When one of the triacs 56 is to be placed in the non-conduction state, the state in which the other of the triacs 56 is prohibited from being placed in the conduction state is released after one of the triacs 56 is placed in the non-conduction state.

Note that, in a normal control of the CPU 94, the control is performed as follows when the heat generation member 54*b* to which power is supplied is changed from one of the heat generation members 54*b* to the other of the heat generation members 54*b*. A drive instruction signal DRV for the other of the heat generation members 54*b* is output after a period equal to or more than the second period has elapsed after a drive instruction signal DRV for one of the heat generation members 54*b* is output. As a result, the heat generation member 54*b* to which power is supplied can be changed. Also for the drive instruction signal DRV_B, the signal /DISABLE_A that invalidates the signal GATE_A is included and a first period and a second period are included. Therefore, even when an abnormality occurs in the CPU 94 and the signal GATE_A and the signal GATE_B are simultaneously placed in the high level state, power can be prevented from being simultaneously supplied to the triac 56*a* and the triac 56*b*. Note that a case where two heat generation members 54*b* to which power is independently supplied are provided has been described in Embodiment 1, but the abovementioned control can be applied without a limit in the number of the heat generation members 54*b*.

[When Number of Heat Generation Members is Increased]

Figure 6:
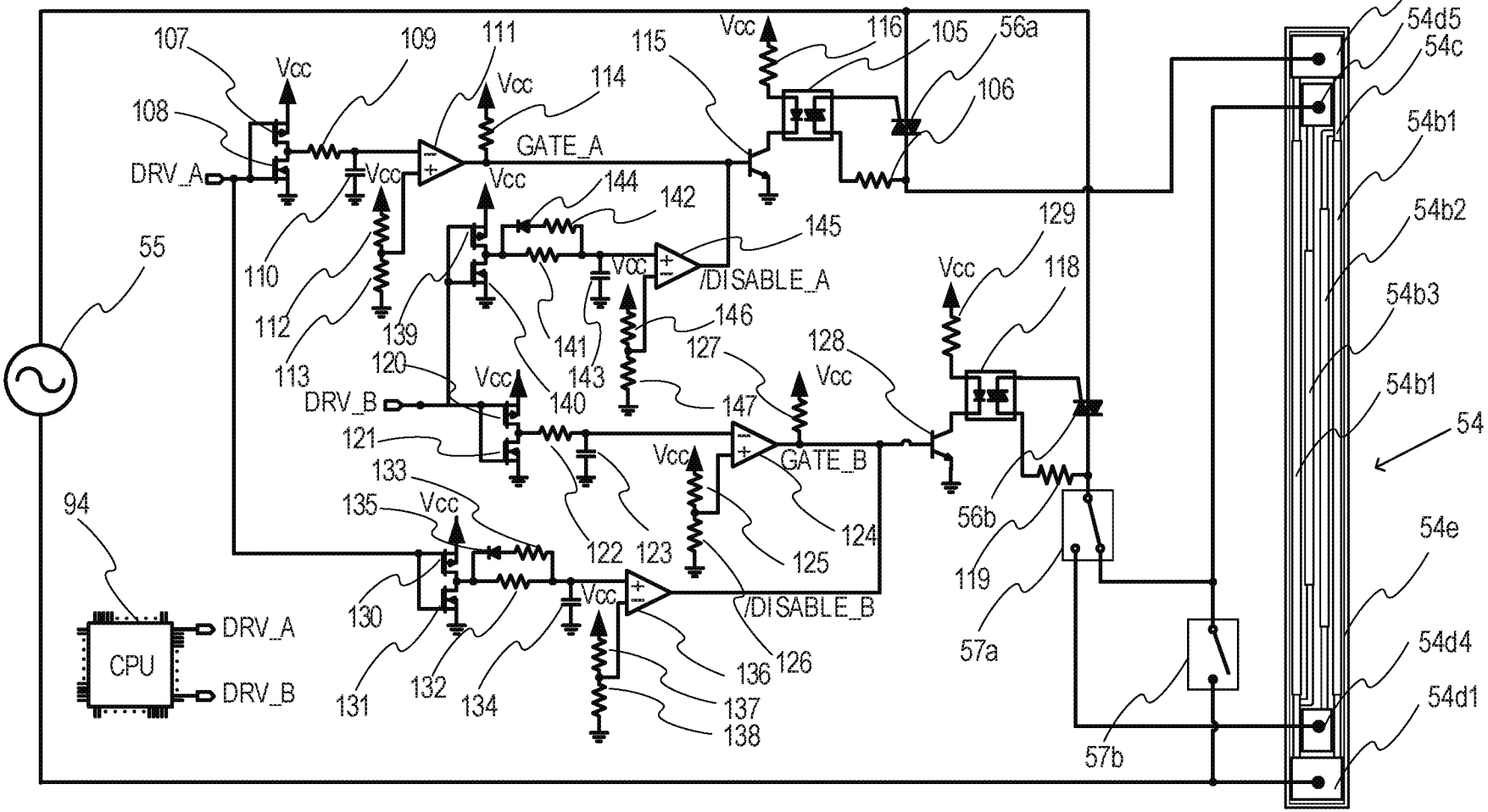
FIG. 6 is an outline view of the control circuit when the number of heat generation members of Embodiment 1 is increased.

FIG. 6 illustrates an outline view of the electrical connection and the configuration of the heater 54 as an example in which the number of the heat generation members 54*b* is increased. Note that the same configurations as the configurations described above are denoted by the same reference characters and the description of the same configurations is omitted. The heater 54 has a configuration including the heat generation members 54*b*1 and 54*b*2, a heat generation member 54*b*3, and contacts 54*d*4 to 54*d*6. The heat generation member 54*b*1, the heat generation member 54*b*2 and the heat generation member 54*b*3 have different sizes, and a relationship of L1>L2>L3 is satisfied where L3 represents a third length that is the length of the heat generation member 54*b*3 in the longitudinal direction of the heat generation member.

As illustrated in FIG. 6, the heat generation member 54*b*1 includes one heat generation member 54*b*1 disposed on one end portion of the substrate 54*a* in the short direction and the other heat generation member 54*b*1 disposed on the other end portion. In the short direction, one heat generation member 54*b*1, the heat generation member 54*b*2, the heat generation member 54*b*3 and the other heat generation member 54*b*1 are disposed in the stated order.

The heat generation members 54*b*1 are electrically connected to the conductor 54*c* via a contact 54*d*1 serving as a first contact and a contact 54*d*6 serving as a second contact, and the power supply is controlled by the triac 56*a*. Note that the heat generation member 54*b*2 is electrically connected to the conductor 54*c* via a contact 54*d*4 serving as a third contact, the contact 54*d*6, a relay 57*a* and a relay 57*b*. The heat generation member 54*b*3 is electrically connected to the conductor 54*c* via the contact 54*d*1, a contact 54*d*5 serving as a fourth contact, the relay 57*a* and the relay 57*b*. Now, by the connection states of the relay 57*a* and the relay 57*b*, one of the heat generation member 54*b*2 and the heat generation member 54*b*3 is placed in an electrically connect state and the power supplied by the triac 56*b* is controlled. Power is prevented from being simultaneously supplied to the triac 56*a* and the triac 56*b*, and hence power is supplied to only one of the heat generation member 54*b*1, the heat generation member 54*b*2 and the heat generation member 54*b*3 in the configuration.

As described above, according to Embodiment 1, even when an abnormality occurs in the control unit, the overheating of the heating apparatus can be prevented by limiting the number of the heat generation members to which power is supplied.

Embodiment 2

[Control Circuit of Embodiment 2]

In the circuit illustrated in FIG. 4 in Embodiment 1, the supplying of power is enabled for the phototriac coupler 105 and the phototriac coupler 118 regardless of the timing of the conduction. When the minimum unit of the power supply to the triac 56*a* and the triac 56*b* is set to a unit of one half wave of the AC power supply 55, a phototriac coupler having a zero cross detection function for driving the triac 56*a* and the triac 56*b* may be used. The phototriac coupler having a zero cross detection function is placed in the conduction state when the voltage across both terminals of the light receiving unit (hereinafter referred to as a both-end voltage) (the potential difference between two terminals) (hereinafter also referred to as voltage across terminals) is equal to or less than a zero cross voltage $V_{zerox}$ (equal to or less than the zero cross voltage). Note that, in detail, the phototriac coupler is placed in the conduction state in a period in which the voltage across terminals of the light receiving unit of the phototriac coupler becomes $-V_{zerox}$ or more and $+V_{zerox}$ or less. The expression above is hereinafter simply referred to as the voltage across terminals becomes equal to or less than $V_{zerox}$. The phototriac coupler having a zero cross detection function is placed in the non-conduction state when the voltage across terminals of the light receiving unit is more than the zero cross voltage $V_{zerox}$. Therefore, when current is supplied to the light emitting unit of the phototriac coupler having a zero cross detection function, the light receiving unit of the phototriac coupler is placed in the conduction state near the zero crossing point of the AC voltage across the AC power supply 55. As a result, control in a unit of one half wave can be performed without information on the zero crossing point of the AC power supply 55.

Figure 7:
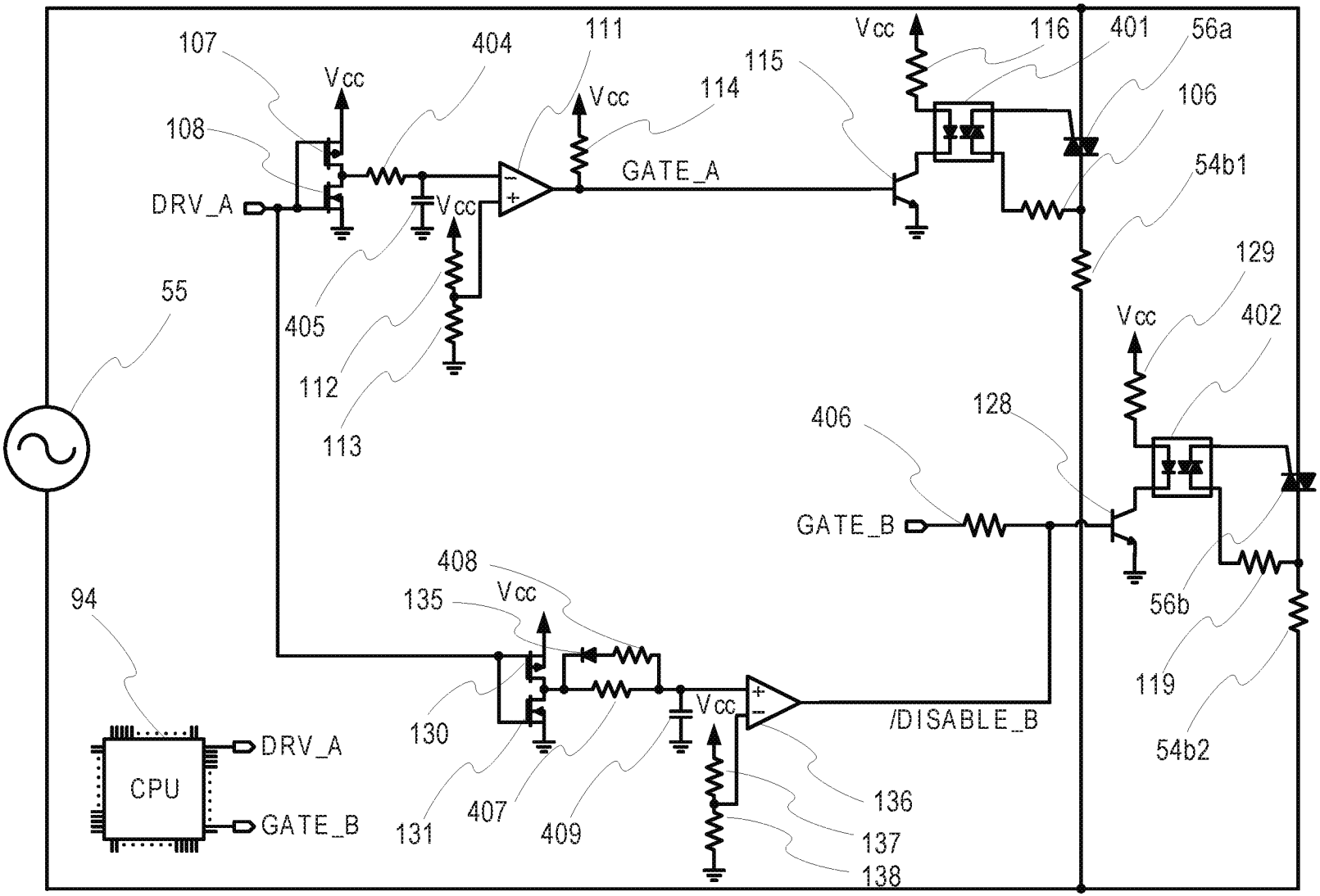
FIG. 7 is an outline view of a control circuit of Embodiment 2.

FIG. 7 illustrates an outline view of the control circuit when the phototriac coupler having a zero cross detection function is used. Note that the same configurations as the configurations described in Embodiment 1 are denoted by the same reference characters, and the description of the same configurations is omitted. Now, phototriac couplers 401 and 402 are phototriac couplers for driving the triac 56*a* and the triac 56*b*. The CPU 94 outputs one of the drive instruction signal DRV_A to be output when the phototriac coupler 401 serving as a first driving unit is driven, and the signal GATE_B that drives the phototriac coupler 402 serving as a second driving unit as the high level signal.

For the case of the triac 56*a*, when the drive instruction signal DRV_A in the high level is output from the CPU 94, a first CMOS output unit formed by the FET 107 and the FET 108 reaches the low level. The first CMOS output unit is connected to the inverting input terminal of the comparator 111 via a resistor 404 and changes by a time constant R404×C405 obtained by the resistor 404 and a capacitor 405. Now, R404 represents a resistance value of the resistor 404 and C405 represents a capacity value of the capacitor 405. The voltage of the inverting input terminal of the comparator 111 is compared with a first reference voltage obtained by the resistor 112 and the resistor 113 connected to the non-inverting input terminal. When the voltage input to the inverting input terminal is less than the first reference voltage, the output terminal of the comparator 111 is placed in a high-impedance state. As a result, the signal GATE_A in the high level is supplied as the base current of the transistor 115, and current flows to the light emitting unit of the phototriac coupler 401. Now, when the voltage across terminals of the light receiving unit of the phototriac coupler 401 is equal to or less than the zero cross voltage $V_{zerox}$, the light receiving unit of the phototriac coupler 401 carries current, and the gate current is supplied to the triac 56*a*. When the current supplied to the triac 56*a* reaches a zero crossing point in a state in which the gate current is not supplied, the triac 56*a* changes from the conduction state to the non-conduction state.

For the case of the triac 56*b*, when the signal GATE_B in the high level is output from the CPU 94, the base current of the transistor 128 is supplied via the resistor 406, and the transistor 128 becomes ON. When the transistor 128 becomes ON, current flows to the light emitting unit of the phototriac coupler 402. Now, when the voltage across terminals of the light receiving unit of the phototriac coupler 402 is equal to or less than the zero cross voltage $V_{zerox}$, the light receiving unit of the phototriac coupler 402 carries current, and the gate current is supplied to the triac 56*b*. When the current supplied to the triac 56*b* reaches a zero crossing point in a state in which the gate current is not supplied, the triac 56*b* changes from the conduction state to the non-conduction state.

(When Transition of Third CMOS Output Unit is H to L)

Meanwhile, when the drive instruction signal DRV_A transitions from the low level to the high level, a third CMOS output unit formed by the FET 130 and the FET 131 transitions from the high level to the low level. Note that, in the third CMOS output unit of Embodiment 2, although some parts have configurations and reference characters different from the configurations and reference characters in the third CMOS output unit of Embodiment 1, the element configurations and the connection configurations are the same and the description of the element configurations and the connection configurations is omitted. As a result, the voltage of the non-inverting input terminal of the comparator 136 decreases by the time constant of {(R407×R408)/(R407+R408)}×C409. In other words, the voltage of the non-inverting input terminal of the comparator 136 decreases with a delay of the time specified by the time constant of resistors 407 and 408 and a capacitor 409 after the output of the drive instruction signal DRV_A changes. Now, R407 and R408 represent resistance values of the resistor 407 and the resistor 408, and C409 represents a capacity value of the capacitor 409. The comparator 136 compares the voltage of the non-inverting input terminal and a third reference voltage obtained by the resistor 137 and the resistor 138 connected to the inverting input terminal. As a result of the comparison by the comparator 136, and the signal /DISABLE_B that is the output terminal of the comparator 136 is placed in the low level state when the voltage of the non-inverting input terminal is less than the third reference voltage. For example, the first reference voltage and the third reference voltage are set as 1/2×Vcc. The relationship of the time constant between the signal /DISABLE_B and the signal GATE_A when the third CMOS output unit transitions from the high level to the low level is expressed as follows:

$$\{(R407\times R408)/(R407+R408)\}\times C409<R404\times C405$$

where a time constant {(R407×R408)/(R407+R408)}×C409 is represented by τ11 and a time constant R404×C405 is represented by τ12. As a result, the signal GATE_A is placed in the high level state after the signal /DISABLE_B is placed in the low level state. In other words, the triac 56*a* is placed in the conduction state after the control of the triac 56*b* is placed in an invalid state first.

(When Transition of Third CMOS Output Unit is L to H)

When the drive instruction signal DRV_A transitions from the high level to the low level, the third CMOS output unit transitions from the low level to the high level. As a result, the voltage of the non-inverting input terminal of the comparator 136 rises by the time constant of R407×C409. In other words, the voltage of the non-inverting input terminal of the comparator 136 rises with a delay of the time specified by the time constant of the resistor 407 and the capacitor 409 after the output of the drive instruction signal DRV_A changes. When the voltage of the non-inverting input terminal is equal to or more than the third reference voltage as a result of the comparison by the comparator 136, the signal /DISABLE_B that is the output terminal of the comparator 136 is placed in a high-impedance state. The relationship of the time constant between the signal /DISABLE_B and the signal GATE_A when the third CMOS output unit transitions from the low level to the high level is expressed as follows:

$$R407\times C409>R404\times C405$$

where a time constant R407×C409 is represented by τ13. As a result, the signal /DISABLE_B is placed in a high-impedance state after the signal GATE_A reaches the low level. In other words, the invalid state of the control of the triac 56*b* is released after the triac 56*a* is placed in the non-conduction state first.

[Operation of Control Circuit]

FIG. 8A to FIG. 8F illustrate the relationship of the timings between the AC power supply 55, the timing at which driving is enabled for the phototriac coupler 401, the drive instruction signal DRV_A, the signal /DISABLE_B, the signal GATE_A and the supply current to the triac 56*a*. FIG. 8A and FIG. 8C to FIG. 8F are graphs illustrating waveforms similar to the waveforms of FIG. 5A to FIG. 5E, and the description of FIG. 8A and FIG. 8C to FIG. 8F is omitted. FIG. 8B illustrates the timing at which driving is enabled for the phototriac coupler 401, and the high level is an "enabling state for driving" and the low level is a "disabling state for driving".

Now, the first reference voltage and the third reference voltage are set as 1/2×Vcc, and the zero cross voltage $V_{zerox}$ of the phototriac coupler 401 is 20 V. The resistor 404 is 18 kΩ, the resistor 407 is 33 kΩ, the resistor 408 is 100Ω, and the capacitor 405 and the capacitor 409 are 0.1 μF. With regards to the zero cross voltage $V_{zerox}$ being 20 V, the time in which the voltage across terminals of the light receiving unit of the phototriac coupler 401 is equal to or less than the zero cross voltage $V_{zerox}$ and is able to carry current is $t_{ssr\ on}$. The period $t_{ssr\ on}$ is limited to a period of about 0.5 msec before and after the zero crossing point of the AC voltage across the AC power supply 55.

(Conduction (ON) of Triac 56*a*)

At a timing t501 at which about 2 msec has elapsed from a timing t500, the drive instruction signal DRV_A in the high level is output from the CPU 94 (FIG. 8C). The signal /DISABLE_B reaches the low level at a timing t502 at which about 8 μsec has elapsed from the timing t501 (FIG. 8D). The time from the timing t501 to the timing t502 corresponds to the time constant τ11. The signal GATE_A reaches the high level at a timing t503 at which about 1.1 msec has elapsed from the timing t501 (FIG. 8E). The time from the timing t501 to the timing t503 corresponds to the time constant τ12.

Now, a period from the timing t502 at which the signal /DISABLE_B reaches the low level to the timing t503 at which the signal GATE_A becomes the high level output is set as a third period (τ12−τ11). The third period is set to be longer than a conduction enabled period $t_{ssr}$ on (τ12−τ11>$t_{ssr\ on}$). The high level state of the signal GATE_A is continued for about 10 msec that is one half-wave cycle of the AC power supply 55. As a result, the conduction enabled period $t_{ssr\ on}$ of the phototriac coupler 401, that is, the period in which driving is enabled is within the period in which the signal GATE_A is in the high level, and the supplying of the gate current of the triac 56*a* starts (FIG. 8F).

(Non-Conduction (OFF) of Triac 56*a*)

The drive instruction signal DRV_A in the low level is output from the CPU 94 at a timing t506 at which about 12 msec has elapsed from the timing t500 (FIG. 8C). The signal GATE_A reaches the low level at a timing t507 at which about 1.1 msec has elapsed from the timing t506 (FIG. 8E). The time from the timing t506 to the timing t507 corresponds to the time constant τ12. The signal /DISABLE_B is placed in a high-impedance state at a timing t508 at which about 2.2 msec has elapsed from the timing t506 (FIG. 8D). The time from the timing t506 to the timing t508 corresponds to the time constant τ13. As with the third period, the period from the timing t507 to the timing t508 is set as a fourth period (τ13−τ12). The fourth period is set to be longer than the conduction enabled period $t_{ssr\ on}$ (τ13−τ12>$t_{ssr\ on}$). In Embodiment 2, the signal /DISABLE_B is placed in a high-impedance state at a timing t508 at which about 1.1 (=2.2−1.1) msec has elapsed in the fourth period.

For example, at the timing t508 at which the signal /DISABLE_B is placed in a high-impedance state, the conduction enabled period $t_{ssr\ on}$ of the phototriac coupler 402 is not obtained even when the signal GATE_B is in the high level (FIG. 8B). Therefore, the supplying of the gate current to the triac 56*b* does not start until a timing t509 at which the zero crossing point when the conduction of the triac 56*a* ends is reached. As described above, in Embodiment 2, the signal /DISABLE_B is a signal in which periods each of which is longer than the conduction enabled period $t_{ssr\ on}$ are provided before and after the high-level output period of the signal GATE_A. By providing periods in which the signal GATE_B is invalidated as above, a configuration that prevents power from being enabled to be simultaneously supplied to both of the triac 56*b* and the triac 56*a* in the same half wave of the AC power supply 55 is obtained.

In other words, when the phototriac coupler having a zero cross detection function is used, only one circuit that limits the other triac may be provided in the configuration. As a result, power can be prevented from being simultaneously supplied to the triac 56*a* and the triac 56*b* even when the drive instruction signal DRV_A and the signal GATE_B are simultaneously placed in the high level state.

[When Number of Heat Generation Members is Increased]

Figure 9:
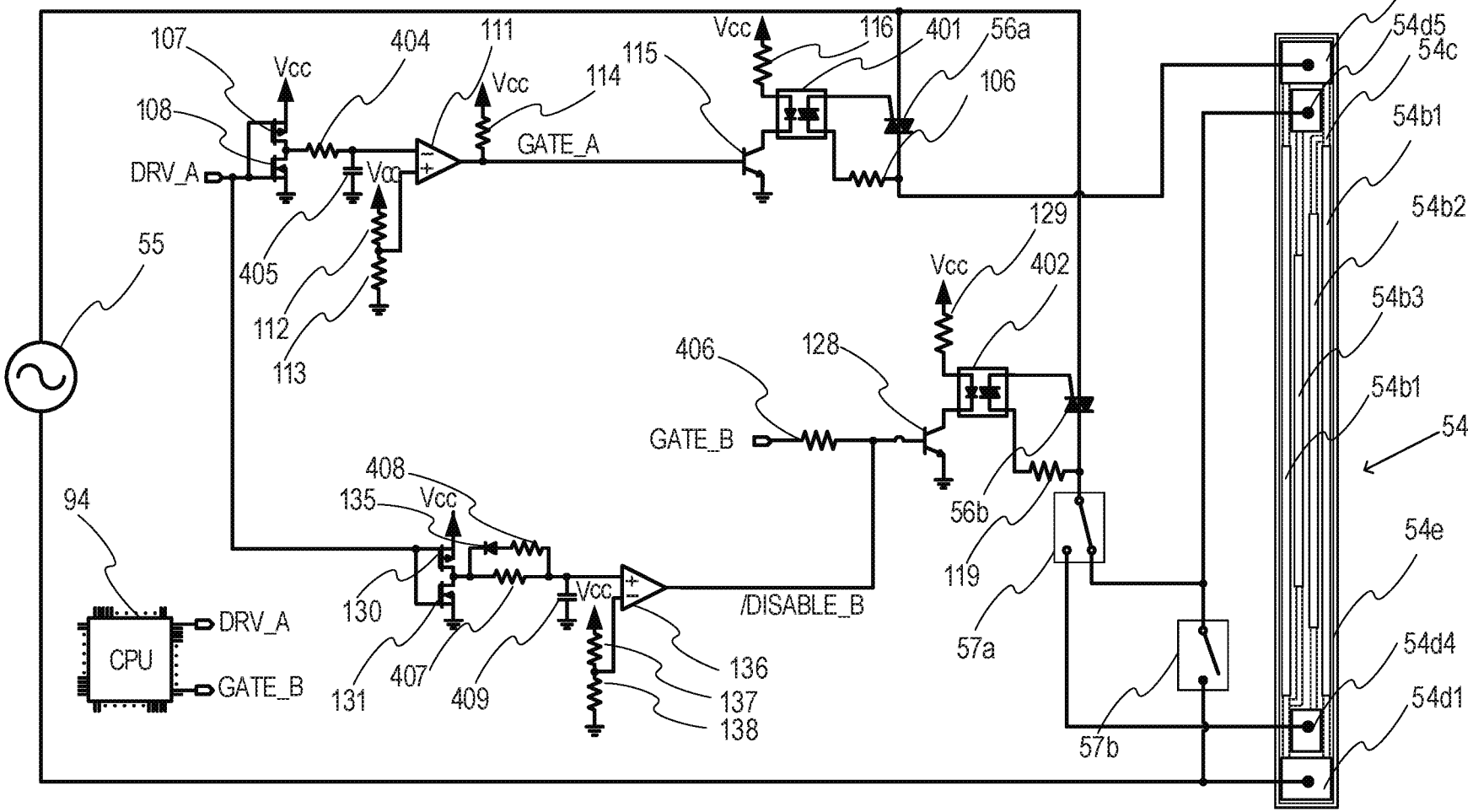
FIG. 9 is an outline view of the control circuit when the number of heat generation members of Embodiment 2 is increased.

Also in a configuration in which the number of the heat generation members 54*b* is increased as illustrated in FIG. 9, power is prevented from being simultaneously supplied to the triac 56*a* and the triac 56*b* as in Embodiment 1. Note that the same configurations as the configurations described above are denoted by the same reference characters, and the description of the same configurations is omitted. Therefore, even when the number of the heat generation members is increased in Embodiment 2, a configuration in which power is supplied to only one of the heat generation member 54*b*1, the heat generation member 54*b*2 and the heat generation member 54*b*3 is obtained.

As described above, according to Embodiment 2, even when an abnormality occurs in the control unit, the overheating of the heating apparatus can be prevented by limiting the number of the heat generation members to which power is supplied.

Embodiment 3

The configuration in which the drive signal is not simultaneously supplied to the plurality of phototriac couplers has been described in Embodiment 1, and the configuration that prevents the light receiving units from being simultaneously placed in the conduction state with use of the characteristics of the phototriac couplers has been described in Embodiment 2. In Embodiment 3, a configuration that selects the power supply voltage to be supplied to the light emitting unit of the phototriac coupler 105 and the light emitting unit of the phototriac coupler 118 is described.

[Control Circuit]

Figure 10:
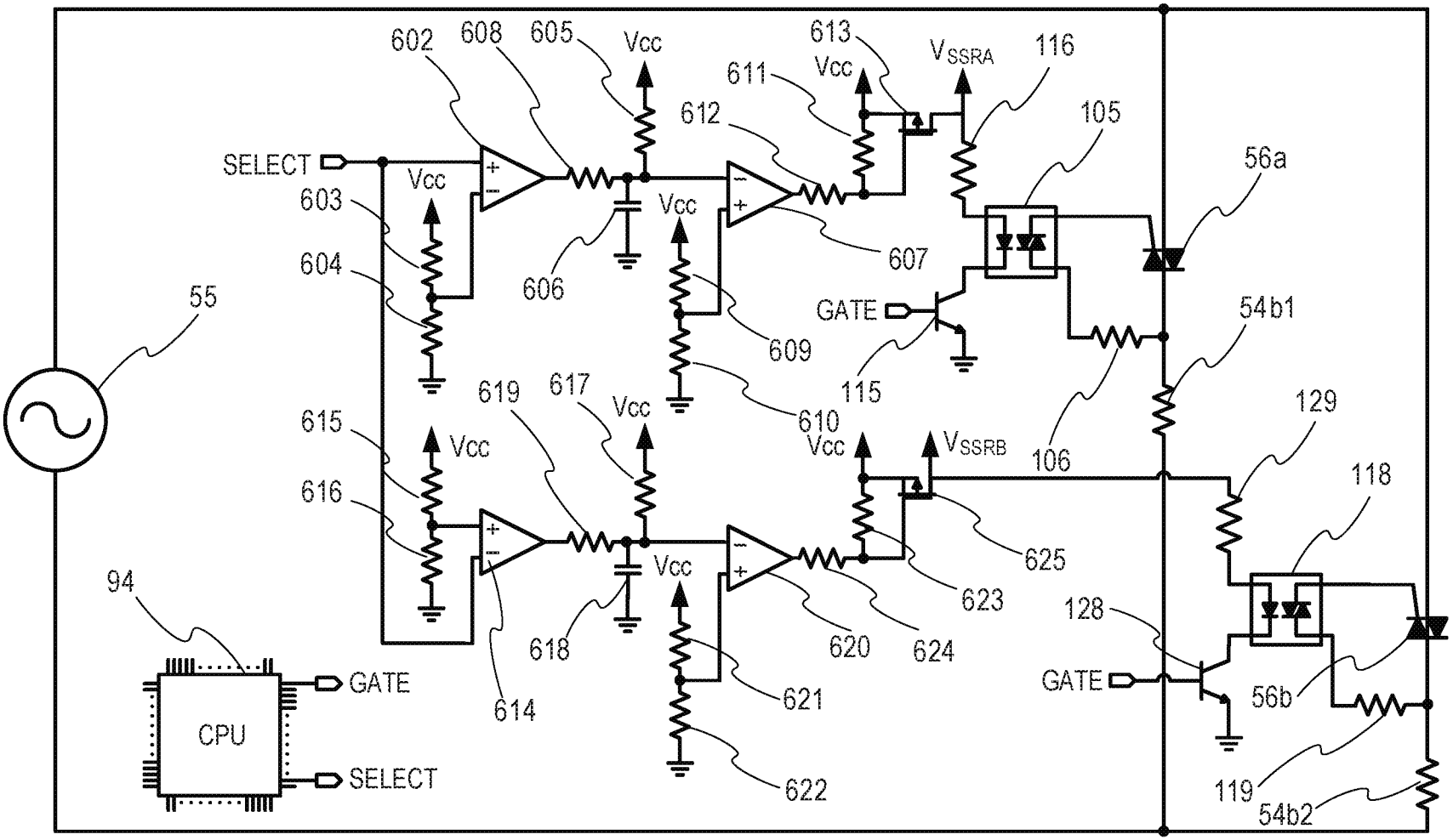
FIG. 10 is an outline view of a control circuit of Embodiment 3.

FIG. 10 illustrates an outline view of a control circuit of Embodiment 3. The CPU 94 controls one of the phototriac coupler 105 and the phototriac coupler 118 with use of two signals, that is, a signal GATE and a signal SELECT. Note that the same configurations as the configurations in FIG. 4 and the like are denoted by the same reference characters, and the description of the same configurations is omitted.

(Phototriac Coupler 105)

For example, when the signal SELECT connected to a non-inverting input terminal of a comparator 602 changes from the low level state to the high level state, the output of the comparator 602 becomes a high-impedance output when the voltage is equal to or more than a fifth reference voltage obtained by a resistor 603 and a resistor 604. When the output of the comparator 602 changes from the low level to a high impedance, the voltage of the inverting input terminal of the comparator 607 rises by a time constant R605×C606 obtained by a resistor 605 and a capacitor 606. In other words, the voltage of the inverting input terminal of the comparator 607 rises with a delay of the time specified by the time constant of the resistor 605 and the capacitor 606 after the output of the signal SELECT changes. Now, R605 represents a resistance value of the resistor 605 and C606 represents a capacity value of the capacitor 606.

When the voltage of the inverting input terminal of the comparator 607 becomes equal to or more than a sixth reference voltage obtained by a resistor 609 and a resistor 610, the output terminal of the comparator 607 is placed in the low level state. The voltage of the output of the comparator 607 is divided by a resistor 611 and a resistor 612, and the divided voltage is applied to the gate terminal of a FET 613. As a result, the FET 613 is placed in the conduction state, and hence a power supply voltage $V_{SSRA}$ serving as a first voltage supplied from a power supply circuit (not shown) (first supply unit) is supplied to the light emitting unit of the phototriac coupler 105. When the CPU 94 outputs the signal GATE in the high level, current flows to the light emitting unit of the phototriac coupler 105, the light receiving unit of the phototriac coupler 105 is placed in the conduction state, and the triac 56*a* is placed in the conduction state.

When the signal SELECT is placed in the low level, the output of the comparator 602 changes from a high impedance to the low level. As a result, the voltage of the inverting input terminal of the comparator 607 decreases by a time constant {(R605×R608)/(R605+R608)}×C606 obtained by the resistor 605, a resistor 608 and the capacitor 606. In other words, the voltage of the inverting input terminal of the comparator 607 decreases with a delay of the time specified by the time constant of the resistors 605 and 608 and the capacitor 606 after the output of the signal SELECT changes. Now, R608 represents a resistance value of the resistor 608. When the voltage of the inverting input terminal of the comparator 607 becomes less than the sixth reference voltage, the output terminal of the comparator 607 is placed in a high-impedance state. As a result, the FET 613 is placed in the non-conduction state, and the power supply voltage $V_{SSRA}$ to the light emitting unit of the phototriac coupler 105 is cut off. As a result, the phototriac coupler 105 is placed in a state of not operating even when the signal GATE in the high level is output.

(Phototriac Coupler 118)

Meanwhile, when the signal SELECT connected to the inverting input terminal of a comparator 614 changes from the high level state to the low level state, the output of the comparator 614 becomes a high-impedance output when the voltage is less than a seventh reference voltage obtained by a resistor 615 and a resistor 616. When the output of the comparator 614 changes from the low level to a high impedance, the voltage of the inverting input terminal of a comparator 620 rises by a time constant R617×C618 obtained by a resistor 617 and a capacitor 618. In other words, the voltage of the inverting input terminal of the comparator 620 rises with a delay of the time specified by the time constant of the resistor 617 and the capacitor 618 after the output of the signal SELECT changes. Now, R617 represents a resistance value of the resistor 617 and C618 represents a capacity value of the capacitor 618.

When the voltage of the inverting input terminal of the comparator 620 becomes equal to or more than an eighth reference voltage obtained by a resistor 621 and a resistor 622, the output terminal of the comparator 620 is placed in the low level state. The voltage of the output of the comparator 620 is divided by a resistor 623 and a resistor 624, and the divided voltage is applied to a gate terminal of a FET 625. As a result, the FET 625 is placed in the conduction state, and hence a power supply voltage $V_{SSRB}$ serving as a second voltage supplied from a power supply circuit (not shown) (second supply unit) is supplied to the light emitting unit of the phototriac coupler 118. When the CPU 94 outputs the signal GATE in the high level, current flows to the light emitting unit of the phototriac coupler 118, the light receiving unit of the phototriac coupler 118 is placed in the conduction state, and the triac 56*b* is placed in the conduction state.

When the signal SELECT reaches the low level, the output of the comparator 614 changes from a high impedance to the low level. As a result, the voltage of the inverting input terminal of the comparator 620 decreases by a time constant {(R617×R619)/(R617+R619)}×C618 obtained by the resistor 617, a resistor 619 and the capacitor 618. In other words, the voltage of the inverting input terminal of the comparator 620 decreases with a delay of the time specified by the time constant of the resistors 617 and 619 and the capacitor 618 after the output of the signal SELECT changes. Now, R619 represents a resistance value of the resistor 619. When the voltage of the inverting input terminal of the comparator 620 becomes less than the eighth reference voltage, the output terminal of the comparator 620 is placed in a high-impedance state. As a result, the FET 625 is placed in the non-conduction state, and the supply of the power supply voltage $V_{SSRB}$ to the light emitting unit of the phototriac coupler 118 is cut off. As a result, the phototriac coupler 118 is placed in a state of not operating even when the signal GATE in the high level is output.

Table 1 indicates the relationship between the output state of the signal SELECT and the triacs 56 enabled to be driven. Table 1 indicates the state (one of H and L) of the signal SELECT output from the CPU 94 in the first row, the power supply voltage that can be supplied in the second row, and the triac 56 to be driven in the third row, the drive signal of the triac to be output from the CPU 94 in the fourth row.

TABLE 1

| Signal SELECT output from CPU 94 | H | L |
|---|---|---|
| Power supply voltage that can be supplied | $V_{SSRA}$ | $V_{SSRB}$ |
| Triac to be driven | Triac 56a | Triac 56b |
| Triac drive signal | GATE | |

When the signal SELECT output from the CPU 94 is in the high level (H), the power supply voltage $V_{SSRA}$ can be supplied, the triac 56*a* is to be driven, and the CPU 94 controls the triac 56*a* by outputting the signal GATE. Meanwhile, when the signal SELECT output from the CPU 94 is in the low level (L), the power supply voltage $V_{SSRB}$ can be supplied, the triac 56*b* is to be driven, and the CPU 94 controls the triac 56*b* by outputting the signal GATE. From the above, for the triac 56*a*, the signal SELECT in the high level corresponds to the first signal, and the signal SELECT in the low level corresponds to the second signal. For the triac 56*b*, the signal SELECT in the low level corresponds to the first signal, and the signal SELECT in the high level corresponds to the second signal. As described above, it can be understood that a state where only one of the triac 56*a* and the triac 56*b* can be driven depending on whether the signal SELECT is in one of the high level state and the low level state is obtained. Note that the power supply voltages $V_{SSRA}$ and $V_{SSRB}$ may be the power supply voltage Vcc.

[Operation of Control Circuit]

Figure 11A:
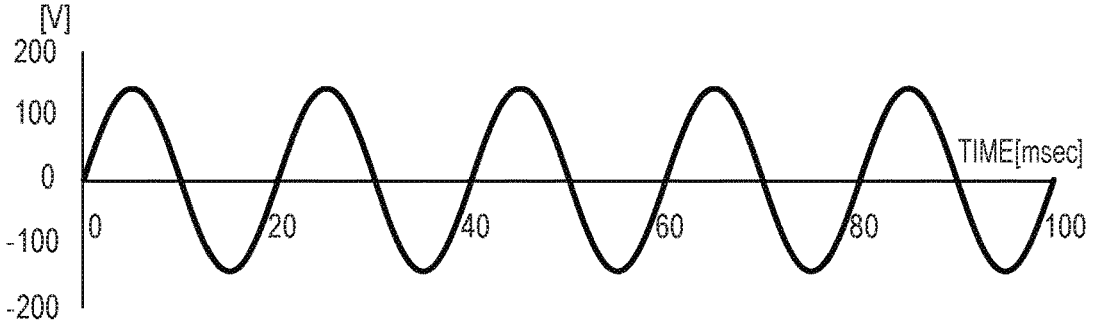
FIG. 11A, FIG. 11B, FIG. 11C, FIG. 11D and FIG. 11E illustrate timing diagrams of waveforms of the control circuit of Embodiment 3.
Figure 11B:
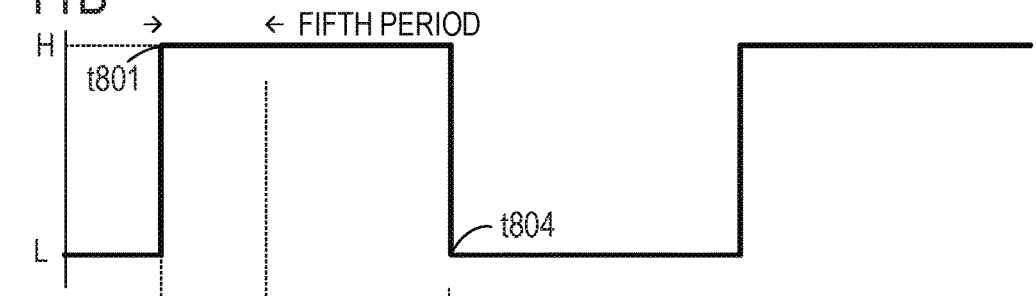
Figure 11C:
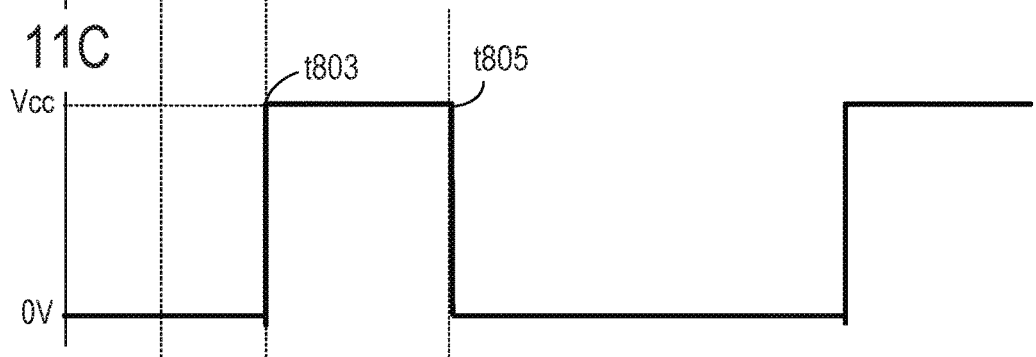
Figure 11D:
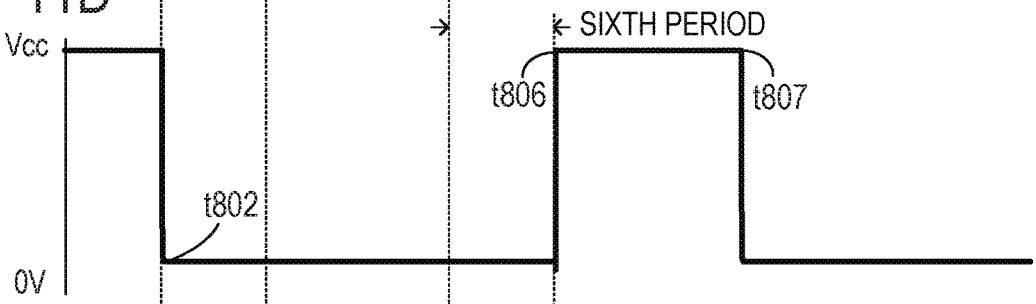
Figure 11E:
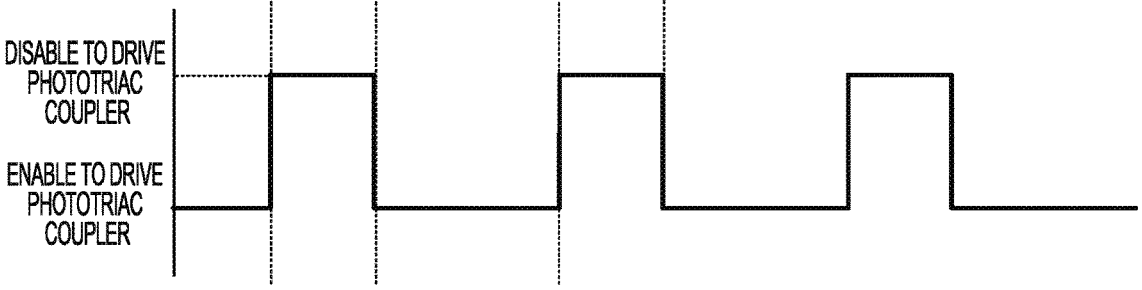

FIG. 11A to FIG. 11E illustrate the relationship between the output states of the power supply voltage $V_{SSRA}$ and the power supply voltage $V_{SSRB}$ when the signal SELECT is switched from the low level to the high level or from the high level to the low level. FIG. 11A illustrates the waveform of the AC power supply 55 [V], and FIG. 11B illustrates the waveform (high level (H) and low level (L)) of the signal SELECT. FIG. 11C illustrates the waveform of the power supply voltage $V_{SSRA}$, and the power supply voltage Vcc is supplied at the high level and 0 V is provided at the low level. FIG. 11D illustrates the waveform of the power supply voltage $V_{SSRB}$, and the power supply voltage Vcc is supplied at the high level and 0 V is provided at the low level. FIG. 11E illustrates the timing at which driving is enabled for the phototriac couplers 105 and 118, and the high level is set to be "disabled" and the low level is set to be "enabled". In all cases, the horizontal axis indicates time [milliseconds (msec)].

Note that the constants of the resistor and the like relating to the waveforms of FIG. 11A to FIG. 11E are follows, for example. The resistor 603, the resistor 604, the resistor 609, the resistor 610, the resistor 615, the resistor 616, the resistor 621 and the resistor 622 are 1 kΩ. The fifth reference voltage to the eighth reference voltage are 1/2×Vcc by the resistor constants. The resistor 605 and the resistor 617 are 33 kΩ, the resistor 608, the resistor 612, the resistor 619 and the resistor 624 are 100Ω, the resistor 611 and the resistor 623 are 10 kΩ and the capacitor 606 and the capacitor 618 are 0.47 μF.

At a timing t801 at which the signal SELECT transitions from the low level to the high level (FIG. 11B), the output of the comparator 620 reaches a high impedance with a delay of about 30 μsec, and the power supply voltage $V_{SSRB}$ is cut off at a timing t802 (FIG. 11D). The output of the comparator 607 reaches a low level state with a delay of about 10.7 msec, and the power supply voltage $V_{SSRA}$ is supplied at a timing t803 (FIG. 11C). As a result, a fifth period of about 10.6 (=10.7−0.03) msec in which neither of the power supply voltage $V_{SSRA}$ nor the power supply voltage $V_{SSRB}$ is output is generated. A period from the timing t803 to the timing t805 is a period in which the driving of the phototriac coupler 105 is enabled (FIG. 11D).

Also in the transition of the signal SELECT from the high level to the low level at a timing t804 (FIG. 11B), the power supply voltage $V_{SSRA}$ is cut off at the timing t805 after about 30 μsec has elapsed (FIG. 11C). The power supply voltage $V_{SSRB}$ is supplied at the timing t806 after about 10.7 msec has elapsed (FIG. 11D). Also in this case, a sixth period of about 10.6 msec in which neither of the power supply voltage $V_{SSRA}$ nor the power supply voltage $V_{SSRB}$ is output is generated. A period from the timing t806 to the timing t807 is a period in which the driving of the phototriac coupler 118 is enabled (FIG. 11E).

In other words, when the triac 56 to be driven is switched, a period longer than one half-wave cycle of the AC power supply 55 is provided as a period in which the gate current can be supplied to neither of the triacs 56. Therefore, even when power is being supplied to one of the triacs 56, the gate current can be supplied to the other of the triacs 56 always after the current that is being supplied reaches a zero crossing point and is stopped.

By the configuration as above, power can be prevented from being simultaneously supplied to the triac 56*a* and the triac 56*b* when an abnormality occurs in the CPU 94 and the signal GATE and the signal SELECT are simultaneously placed in the high level state. Power can also be prevented from being simultaneously supplied to the triac 56*a* and the triac 56*b* even when those signals transition from the high level to the low level or vice versa at an abnormal timing.

[When Number of Heat Generation Members is Increased]

Figure 12:
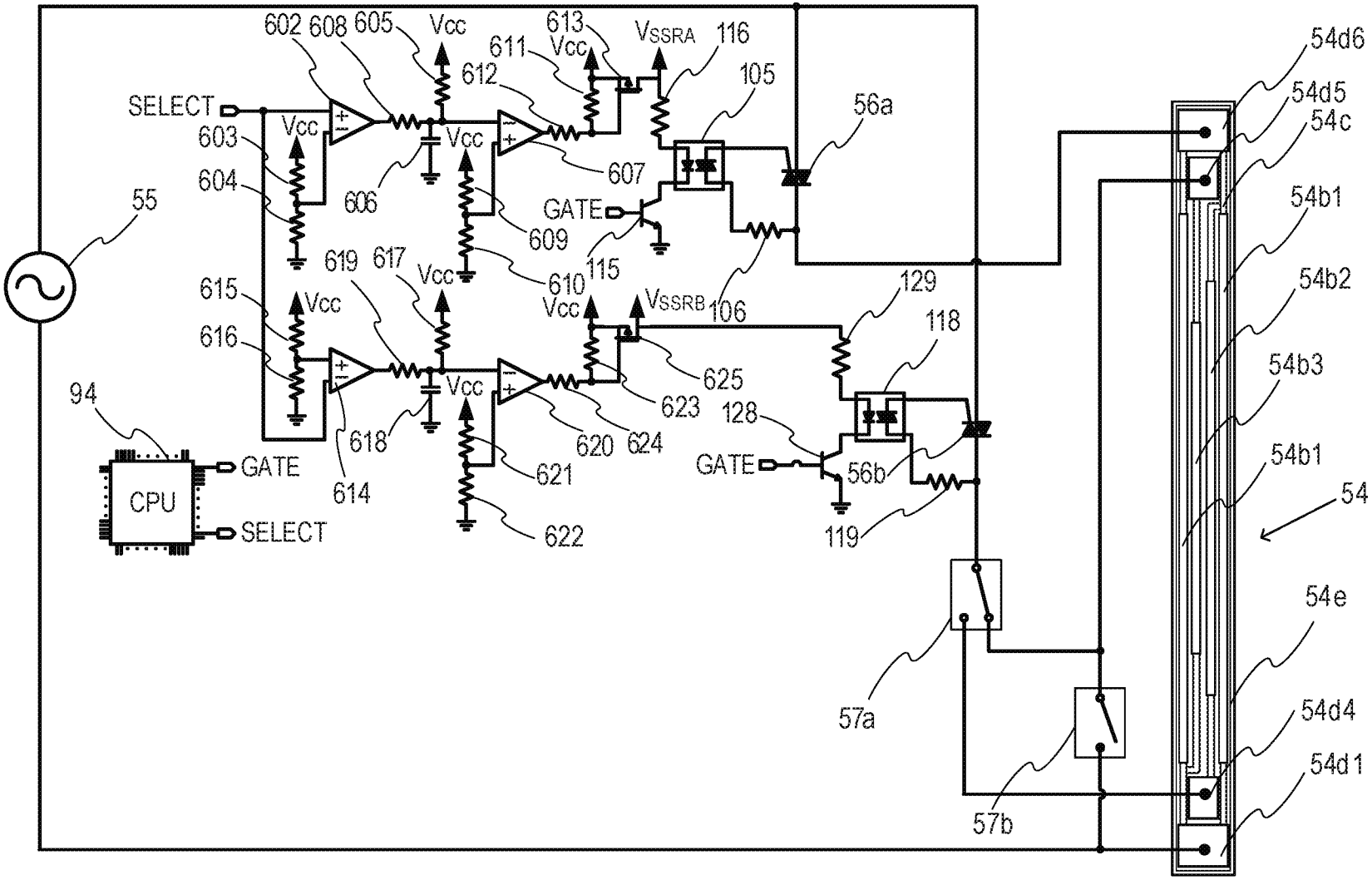
FIG. 12 is an outline view of the control circuit when the number of heat generation members of Embodiment 3 is increased.

Also in a configuration in which the number of the heat generation members 54*b* is increased as illustrated in FIG. 12, power is prevented from being simultaneously supplied to the triac 56*a* and the triac 56*b* as in Embodiment 1. Note that the same configurations as the configurations described above are denoted by the same reference characters, and the description of the same configurations is omitted. Therefore, even when the number of the heat generation members is increased in Embodiment 3, a configuration in which power is supplied to only one of the heat generation member 54*b*1, the heat generation member 54*b*2, and the heat generation member 54*b*3 is obtained.

As described above, according to Embodiment 3, even when an abnormality occurs in the control unit, the overheating of the heating apparatus can be prevented by limiting the number of the heat generation members to which power is supplied.

According to the present invention, even when an abnormality occurs in the control unit, the overheating of the heating apparatus can be prevented by limiting the number of the heat generation members to which power is supplied.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-006467, filed Jan. 18, 2019, which is hereby incorporated by reference herein in its entirety.

What is claimed is:

1. A heating apparatus comprising:

a plurality of heaters including a first heater, a second heater, and a third heater, the plurality of heaters being configured to generate heat by power supplied from a power supply;

a plurality of electronic switches provided to correspond to each of the plurality of heaters, respectively, the plurality of electronic switches each being configured to be switched between a conduction state in order to supply power to the respective heater and a non-conduction state in order to cut off supply of the power; and a control unit configured to control the plurality of electronic switches; and a substrate on which the plurality of heaters including the first heater, another first heater, the second heater, and the third heater are provided, wherein in a case where the control unit outputs a first signal for placing a first electronic switch in the conduction state, the first electronic switch provided to correspond to the first heater becomes in the conduction state after a second electronic switch provided to correspond to the second heater becomes in a prohibition state in which the second electronic switch is prohibited to be in the conduction state, wherein in a case where the control unit outputs a second signal for placing the first electronic switch in the non-conduction state, the prohibition state of the second electronic switch is released after the first electronic switch is placed in the non-conduction state, wherein a length of the first heater is a first length in a longitudinal direction, wherein a length of the second heater is a second length shorter than the first length in the longitudinal direction, wherein a length of the third heater is a third length shorter than the second length in the longitudinal direction, wherein the first heater is provided on one end portion of the substrate in a short direction of the substrate and the another of the first heater is disposed on another end portion of the substrate, and wherein the first heater, the second heater, the third heater, and the another first heater are disposed in the short direction in that order, wherein the heating apparatus further comprises:

a first contact electrically connected to one end portion of the first heater, one end portion of the another first heater, and one end portion of the third heater;

a second contact electrically connected to another end portion of the first heater, another end portion of the another first heater, and another end portion of the second heater;

a third contact electrically connected to one end portion of the second heater; and a fourth contact electrically connected to another end portion of the third heater.

2. A heating apparatus according to claim 1, wherein a period from when the first electronic switch is placed in the non-conduction state to when the prohibition state is released is longer than a half cycle of an AC voltage of the power supply.

3. A heating apparatus according to claim 2, comprising:

a first coupler configured to drive the first electronic switch;

a second coupler configured to drive the second electronic switch;

a first drive signal unit including a resistor and a capacitor for determining a time constant, the first drive signal unit configured to output a first drive signal for placing the first coupler in the conduction state when the first signal is input to the first drive signal unit and output a second drive signal for placing the first coupler in the non-conduction state when the second signal is input to the first drive signal unit; and a second drive signal unit including a resistor and a capacitor for determining a time constant, the second drive signal unit configured to output a prohibiting signal for placing the second coupler in the non-conduction state when the first signal is input to the second drive signal unit and output a release signal for placing the second coupler in the conduction state when the second signal is input to the second drive signal unit, wherein the time constant of the second drive signal unit is set to be smaller than the time constant of the first drive signal unit in a case where a signal to be input changes from the second signal to the first signal, and is set to be larger than the time constant of the first drive signal unit in a case where the signal to be input changes from the first signal to the second signal.

4. A heating apparatus according to claim 3, wherein each of the first coupler and the second coupler is a phototriac coupler including a light emitting unit, a light receiving unit and a function of enabling conduction only when voltage across both ends of the light receiving unit is equal to or less than a predetermined voltage.

5. A heating apparatus according to claim 4, wherein time from when the prohibiting signal is output to when the phototriac coupler is placed in a conduction state is longer than time during which the voltage across both ends of the light receiving unit of the phototriac coupler is equal to or less than a zero cross voltage.

6. A heating apparatus according to claim 4, wherein time from when the phototriac coupler is placed in the non-conduction state to when the release signal is output is longer than time during which the voltage across both ends of the light receiving unit of the phototriac coupler is equal to or less than a zero cross voltage.

7. A heating apparatus according to claim 4, wherein the control unit continues to output the first signal during the half cycle.

8. A heating apparatus according to claim 2, comprising:

a first coupler configured to drive the first electronic switch;

a second coupler configured to drive the second electronic switch;

a first power supply circuit configured to supply a first voltage for driving the first coupler; and a second power supply circuit configured to supply a second voltage for driving the second coupler, wherein in a case where the control unit outputs the first signal, the first voltage is supplied from the first power supply circuit, and wherein in a case where the control unit outputs the second signal, the second voltage is supplied from the second power supply circuit.

9. A heating apparatus according to claim 8, wherein the heating apparatus has a period in which both the first voltage and the second voltage are supplied.

10. An image forming apparatus comprising:

an image forming unit configured to form an unfixed toner image on a recording material; and a heating apparatus according to claim 1, wherein the heating apparatus fixes the unfixed toner image onto the recording material.

11. An image forming apparatus according to claim 10, comprising:

a first rotary member heated by the plurality of the heaters; and a second rotary member configured to form a nip portion together with the first rotary member.

12. An image forming apparatus according to claim 11, wherein the first rotary member is a film.

13. An image forming apparatus according to claim 12, wherein the plurality of heaters is provided to be in contact with an inner surface of the film, and wherein the nip portion is formed through the film with the plurality of heaters and the second rotary member.

14. A heating apparatus comprising:

a plurality of heaters including a first heater and a second heater, the plurality of heaters being configured to generate heat by power supplied from a power supply;

a plurality of electronic switches provided to correspond to each of the plurality of heaters, respectively, the plurality of electronic switches being configured to be switched between a conduction state in order to supply power to the respective heater and a non-conduction state in order to cut off supply of the power; and a control unit configured to control the plurality of electronic switches, wherein in a case where the control unit outputs a first signal for placing a first electronic switch in the conduction state, the first electronic switch provided to correspond to the first heater becomes in the conduction state after a second electronic switch provided to correspond to the second heater becomes in a prohibition state in which the second electronic switch is prohibited to be in the conduction state, wherein in a case where the control unit outputs a second signal for placing the first electronic switch in the non-conduction state, the prohibition state of the second electronic switch is released after the first electronic switch is placed in the non-conduction state, wherein a period from when the first electronic switch is placed in the non-conduction state to when the prohibition state is released is longer than a half cycle of an AC voltage of the power supply, and wherein the heating apparatus comprises:

a first coupler configured to drive the first electronic switch;

a second coupler configured to drive the second electronic switch;

a first drive signal unit including a resistor and a capacitor for determining a time constant, the first drive signal unit configured to output a first drive signal for placing the first coupler in the conduction state when the first signal is input to the first drive signal unit and output a second drive signal for placing the first coupler in the non-conduction state when the second signal is input to the first drive signal unit; and a second drive signal unit including a resistor and a capacitor for determining a time constant, the second drive signal unit configured to output a prohibiting signal for placing the second coupler in the non-conduction state when the first signal is input to the second drive signal unit and output a release signal for placing the second coupler in the conduction state when the second signal is input to the second drive signal unit, wherein the time constant of the second drive signal unit is set to be smaller than the time constant in the first drive signal unit in a case where a signal to be input changes from the second signal to the first signal, and is set to be larger than the time constant in the first drive signal unit in a case where the signal to be input changes from the first signal to the second signal.

15. A heating apparatus comprising:

a plurality of heater including a first heater and a second heater, the plurality of heaters being configured to generate heat by power supplied from a power supply;

a plurality of electronic switches provided to correspond to each of the plurality of heaters, respectively, the plurality of electronic switches configured to be switched between a conduction state in order to supply power to the respective heater and a non-conduction state in order to cut off supply of the power; and a control unit configured to control the plurality of electronic switches, wherein in a case where the control unit outputs a first signal for placing a first electronic switch in the conduction state, the first connection unit provided to correspond to the first heater becomes in the conduction state after a second electronic switch provided to correspond to the second heater becomes in a prohibition state in which the second electronic switch is prohibited to be in the conduction state, and wherein in a case where the control unit outputs a second signal for placing the first electronic switch in the non-conduction state, the prohibition state of the second electronic switch is released after the first electronic switch is placed in the non-conduction state, wherein a period from when the first electronic switch is placed in the non-conduction state to when the prohibition state is released is longer than a half cycle of an AC voltage of the power supply, and wherein the heating apparatus comprises:

a first coupler configured to drive the first electronic switch;

a second coupler configured to drive the second electronic switch;

a first power supply circuit configured to supply a first voltage for driving the first coupler; and a second power supply circuit configured to supply a second voltage for driving the second coupler, wherein in a case where the control unit outputs the first signal, the first voltage is supplied from the first power supply circuit, and wherein in a case where the control unit outputs the second signal, the second voltage is supplied from the second power supply circuit.

16. A heating apparatus according to claim 15, wherein the heating apparatus has a period in which both the first voltage and the second voltage are supplied.

* * * * *